US007479357B2

(12) United States Patent
Law et al.

(10) Patent No.: US 7,479,357 B2
(45) **Date of Patent: *Jan. 20, 2009**

(54) ELECTROPHOTOGRAPHIC ORGANOPHOTORECEPTORS WITH NOVEL CHARGE TRANSPORT MATERIALS

(75) Inventors: Kam W. Law, Woodbury, MN (US); Nusrallah Jubran, St. Paul, MN (US); Zbigniew Tokarski, Woodbury, MN (US); Alan R. Katritzky, Gainesville, FL (US); Ritu Jain, Gainesville, FL (US); Rexiat Maimait, Cincinnati, OH (US); Anatoliy V. Vakulenko, Gainesville, FL (US)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 25 days.

This patent is subject to a terminal disclaimer.

(21) Appl. No.: 10/243,960

(22) Filed: Sep. 13, 2002

(65) Prior Publication Data

US 2003/0104294 A1 Jun. 5, 2003

Related U.S. Application Data

(60) Provisional application No. 60/347,180, filed on Jan. 8, 2002, provisional application No. 60/347,183, filed on Jan. 8, 2002, provisional application No. 60/347,185, filed on Jan. 8, 2002, provisional application No. 60/347,049, filed on Jan. 8, 2002, provisional application No. 60/347,186, filed on Jan. 8, 2002, provisional application No. 60/347,048, filed on Jan. 8, 2002, provisional application No. 60/347,190, filed on Jan. 8, 2002, provisional application No. 60/322,135, filed on Sep. 14, 2001, provisional application No. 60/322,303, filed on Sep. 14, 2001.

(51) Int. Cl.
*G03G 5/047* (2006.01)

(52) U.S. Cl. ..... 430/58.15; 430/58.45; 430/58.5; 430/58.55; 430/58.6; 430/72; 430/75; 430/76; 430/78; 430/79; 399/159; 548/251; 548/255; 548/257; 548/307.4; 548/309.7; 548/326.5; 548/331.1; 548/360.1; 548/371.4; 548/371.7; 548/440; 548/444; 548/483; 548/503; 548/557; 548/558; 549/68; 564/250; 564/251

(58) Field of Classification Search ..... 430/58.15, 430/58.45, 58.4, 72, 73, 75, 58.35, 58.55, 430/76, 78, 58.5, 58.6, 79; 564/251, 250; 399/159, 162; 548/371.4, 251, 257, 255, 548/360.1, 326.5, 307.4, 309.7, 483, 440, 548/444, 557, 558, 503, 331.1, 371.7; 549/68
See application file for complete search history.

(56) References Cited

U.S. PATENT DOCUMENTS 4,297,426 A 10/1981 Sakai et al. ..... 430/79
4,298,676 A * 11/1981 Barton et al. ..... 430/221

(Continued)

FOREIGN PATENT DOCUMENTS

CN 1276542 12/2000

(Continued)

OTHER PUBLICATIONS

Japanese Patent Office machine-assisted translation of JP 11-035540, pub. Sep. 1999.*

(Continued)

*Primary Examiner*—Janis L Dote
(74) *Attorney, Agent, or Firm*—DLA Piper US LLP

(57) ABSTRACT

An organophotoreceptor that includes:

(a) a charge transport material having the formula wherein A is selected from heterocyclic groups, naphthyl group, alkylsulfonylphenyl, stilbenyl or the group X, wherein X is represented by the formula B is selected from hydrogen, alkyl group, and an aryl group, with the proviso that when A is naphthyl, B is naphthyl; or where $R_1$ is selected from the group consisting of N-pyrrolyl, N-pyrazolyl, N-tetrazolyl, N-indolyl, N-carbazolyl, N-triazolyl, N-imidazolyl, N-benzimidazolyl, N-indazolyl, and N-benzotriazolyl group, and $R_3$ is a 9-fluorenone group.

(b) a charge generating compound; and (c) an electrically conductive substrate.

44 Claims, No Drawings

U.S. PATENT DOCUMENTS

| | | | | | |
|---|---|---|---|---|---|
| 4,476,137 | A | | 10/1984 | Haviv et al. | 424/272 |
| 4,786,571 | A | | 11/1988 | Ueda | 430/81 |
| 4,957,838 | A | | 9/1990 | Aruga et al. | 430/56 |
| 5,059,503 | A | * | 10/1991 | Muto et al. | 430/83 |
| 5,128,227 | A | | 7/1992 | Monbaliu et al. | 430/74 |
| 5,274,116 | A | | 12/1993 | Martin et al. | 548/465 |
| 5,642,188 | A | | 6/1997 | Mochizuki et al. | |
| 5,737,669 | A | * | 4/1998 | Ring | 399/130 |
| 5,863,688 | A | * | 1/1999 | Watanabe et al. | 430/133 |
| 5,932,384 | A | | 8/1999 | Mistsumori et al. | 430/83 |
| 6,001,522 | A | | 12/1999 | Woo et al. | 430/65 |
| 6,020,096 | A | | 2/2000 | Fuller et al. | 430/58.35 |
| 6,030,734 | A | | 2/2000 | Mitsumori | 430/58.8 |
| 6,066,426 | A | | 5/2000 | Mott et al. | 430/58.2 |
| 6,099,996 | A | | 8/2000 | Yanus et al. | 430/58.8 |
| 6,140,004 | A | | 10/2000 | Mott et al. | 430/132 |
| 6,214,503 | B1 | | 4/2001 | Gaidelis et al. | 430/58.45 |
| 6,340,548 | B1 | | 1/2002 | Jubran et al. | 430/58.45 |
| 7,063,928 | B2 | | 6/2006 | Law et al. | |
| 2003/0198880 | A1 | * | 10/2003 | Law et al. | 430/58.45 |

FOREIGN PATENT DOCUMENTS

| | | | | |
|---|---|---|---|---|
| EP | 0390196 | | | 10/1990 |
| EP | 0615165 | A2 | | 3/1994 |
| GB | 1047525 | | | 11/1966 |
| JP | 59-195246 | | * | 6/1984 |
| JP | 60177350 | | | 9/1985 |
| JP | 01222264 | | | 9/1989 |
| JP | 07209886 | | | 8/1995 |
| JP | 01-293351 | | | 2/1999 |
| JP | 11-035540 | | * | 9/1999 |

OTHER PUBLICATIONS

Grant, R. et al., ed., *Grant & Hackh's Chemical Dictionary*, fifth edition, McGraw-Hill Book Co., NY (1987), p. 80.*

Daimond, A.S., ed., *Handbook of Imaging Materials*, Marcel Dekker, Inc., NY (1991), pp. 395-396.*

Japanese Patent Office English-language abstract describing JP 59-195246, copyright 1998.*

Derwent abstract, Acc. No. 84-310272/50 describing JP 59-195246, 1985.*

U.S. Appl. No. 60/355,079, filed Feb. 8, 2002.*

U.S. Appl. No. 60/355,080, filed Feb. 8, 2002.*

U.S. Appl. No. 60/355,018, filed Feb. 8, 2002.*

USPTO English-language translation of JP 59-195246 (pub. Nov. 1984).*

USPTO English-language translation of JP 60-177350 (pub. Sep. 1985).*

Atherton, F.R., et al., "Synthesis of 3(S)-Acylamino-1-[(Phenyl)(1H-Tetrazol-5-YL) Amino]-2-2-Azetidinones," *Tetrahedron*, vol. 39, No. 15, pp. 2599-2608, 1983.

Boyd, G. V., et al., "The Dimerisation of 5-Methylene—Δ2—1-3-4-oxadiaolines" *J. Chem. Soc.*(C) vol. 12, pp. 2314-2317, 1970.

Murakami, Y., et al., "An Efficient Synthesis of 1, 1-Disubstituted Hydrazines," *Chem. & Pharmaceutical Bulletin* vol. 31, No. 2, pp. 423-428, Feb. 1983.

Skelettumlaterungen unter Electronenbeschuss by U.Rapp, H.A. Staab and C. Wünsche; Tetrahedron, Vo. 27, pp. 2679-2689, 1971.

3H-Azolo-1,2,4-triazole durch 1,8- bzw. 1,12-Elektrocyclisierungen von 3H-Pyrazon-3-on- bzw. 3H-Indazon-3-on-(diorganylmethylen)hydrazonen by Günter Edge, Karlheinz Gilbert and Reinhard Heck, Chem. Ber. 117, 1726-1747 (1984).

Synthesis and biological activity of 1,2,4-triazinotriazinone derivatives by A.M. Abdel-Halim, A. El-Gendy and R.M. Abdel-Rahman, Pharmazie 50 (1995) H. 11, pp. 726-729.

* cited by examiner

ELECTROPHOTOGRAPHIC ORGANOPHOTORECEPTORS WITH NOVEL CHARGE TRANSPORT MATERIALS

CROSS REFERENCE TO RELATED APPLICATIONS

This application claims priority to U.S. Provisional Patent Application Ser. Nos. 60/322,135, filed Sep. 14, 2001; 60/322,303, filed Sep. 14, 2001; 60/347,180, filed Jan. 8, 2002; 60/347,183, filed Jan. 8, 2002, 60/347,185, filed Jan. 8, 2002; 60/347,049, filed Jan. 8, 2002; 60/347,186, filed Jan. 8, 2002; 60/347,048, filed Jan. 8, 2002; and 60/347,190, filed Jan. 8, 2002.

FIELD OF INVENTION

This invention relates to organophotoreceptors suitable for use in electrophotography and, more specifically, to organophotoreceptors having novel charge transport materials comprising 9H-fluoren-9-one hydrazino substituted compounds and their derivatives.

BACKGROUND

In electrophotography, an organophotoreceptor in the form of a plate, belt, disk, or drum having an electrically insulating photoconductive element on an electrically conductive substrate is imaged by first uniformly electrostatically charging the surface of the photoconductive layer, and then exposing the charged surface to a pattern of light. The light exposure selectively dissipates the charge in the illuminated areas where light strikes the surface, thereby forming a pattern of charged and uncharged areas (referred to as latent image). A fine liquid or solid toner is then provided in the vicinity of the latent image, and toner droplets or particles deposit in either the charged or uncharged areas to create a toned image on the surface of the photoconductive layer. The resulting visible toner image can be transferred to a suitable permanent or intermediate receiving surface such as paper, or the photoconductive layer can operate as a permanent receptor for the image. The imaging process can be repeated many times to overlay images of distinct color components or effect shadow images, such as overlaying images of distinct colors to form a full color final image.

Both single layer and multilayer photoconductive elements have been used commercially. In the single layer embodiment, a charge transport material and charge generating material are combined with a polymeric binder and then deposited on an electrically conductive substrate. In the multilayer embodiment, the charge transport material and charge generating material are present in the element in separate layers, each of which materials can optionally be combined with a polymeric binder and deposited on the electrically conductive substrate. Two arrangements are possible for the multilayer embodiment. In one arrangement (the "dual layer" two layer arrangement), the charge generating layer is deposited on the electrically conductive substrate and the charge transport layer is deposited on top of the charge generating layer. In an alternate arrangement (the "inverted dual layer" two layer arrangement), the order of the charge transport layer and charge generating layer is reversed.

In both the single and multilayer photoconductive elements, the purpose of the charge generating material is to generate charge carriers (i.e., holes or electrons) upon exposure to light. The purpose of the charge transport material is to accept these charge carriers and transport them through the charge transport layer in order to discharge a surface charge on the photoconductive element. When a charge transport compound is used, the charge transport compound accepts the hole carriers and transports them through the layer where the charge transport compound is in. When an electron transport compound is used, the electron transport compound accepts the electron carriers and transports them through the layer where the electron transport compound is in.

To produce high quality images, particularly after multiple cycles, it is desirable for the charge transport material to form a homogeneous solution with the polymeric binder and remain in solution. In addition, it is desirable to maximize the amount of charge which the charge transport material can accept (indicated by a parameter known as the acceptance voltage or "$V_{acc}$"), and to minimize retention of that charge upon discharge (indicated by a parameter known as the residual voltage or "$V_{res}$").

There are many charge transport materials available for electrophotography. The most common charge transport materials are pyrazoline derivatives, fluorene derivatives, oxadiazole derivatives, stilbene derivatives, hydrazone derivatives, carbazole hydrazone derivatives, triphenylamine derivatives, julolidine hydrazone derivatives, polyvinyl carbazole, polyvinyl pyrene, or polyacenaphthylene. However, each of the above charge transport materials suffers some disadvantages. There is always a need for novel charge transport materials to meet the various requirements of electrophotography applications.

SUMMARY OF THE INVENTION

In a first aspect, the invention features an organophotoreceptor that includes organophotoreceptors suitable for use in electrophotography and, more specifically, to organophotoreceptors having novel charge transport materials comprise 9H-fluoren-9-one hydrazino substituted compounds.

The generic formula for the compounds of the present invention may be represented by the central nucleus of at least one of the following formula:

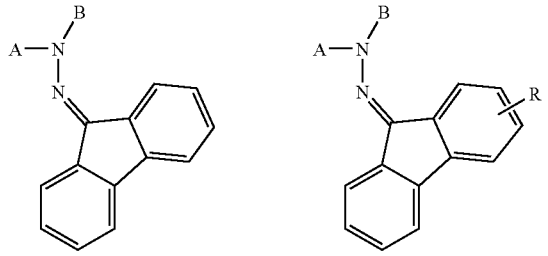

wherein A is selected from the group consisting of heterocyclic groups (e.g. sulfolanyl, pyrrolyl, pyrazolyl, tetrazolyl, indolyl, carbazolyl, triazolyl, imidazolyl, benzimidazolyl, indazolyl, or benzotriazolyl group), naphthyl group, alkylsulfonylphenyl, stilbenyl, and the group X, wherein X is represented by the formula

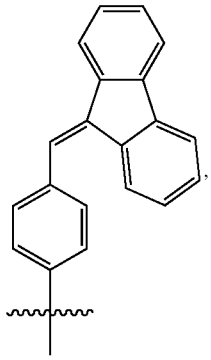

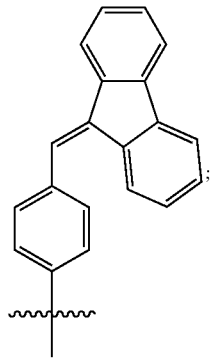

B is selected from the group consisting of hydrogen, alkyl group, and an aryl group (e.g., phenyl group, naphthyl group, stilbenyl group, or tolanyl group), and R is selected from the group consisting of hydrogen, a halogen, hydroxyl, thiol, nitro, nitrile, a branched or linear alkoxy group, a branched of linear alkyl group, a branched , cyclic or linear unsaturated hydrocarbon group, an ester group, an ether group, an amino group, a heterocyclic group, an aryl group, and a part of a cyclic or polycyclic ring, with the proviso that when A is naphthyl, B is naphthyl. It is preferred that heterocyclic groups have 5-, 6- or 7-member nucleus groups comprising C, N, S, Se and O ring atoms, with no more than two atoms comprising Se, S and/or O, nor more than two atoms selected from a combination of N and at least one of Se, O or S, and no more than 4 N atoms (with no S or O present).

Substitution is liberally allowed on the groups and on the nucleus to effect various physical effects on the properties of the compounds, such as mobility, solubility, stability, and the like, as is known in the art. This invention also covers isomeric equivalencies of the above central nuclei, meaning that A and B are interchangeable within the limits of these definitions.

Subgeneric formulae that represent subgroups of compounds within the practice of the present invention include the later presented formulae (I-X).

The organicphotoreceptors would include a charge transport material and associated structure, such as, for example, a charge transport material having the formula 1:

(1)

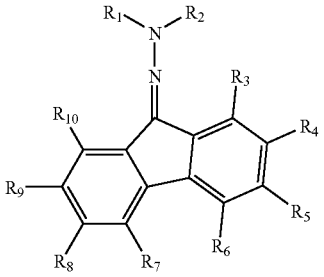

where $R_1$ is a heterocyclic group (e.g. sulfolanyl, pyrrolyl, pyrazolyl, tetrazolyl, indolyl, carbazolyl, triazolyl, imidazolyl, benzimidazolyl, indazolyl, or benzotriazolyl group), naphthyl group, alkylsulfonylphenyl, stilbenyl, or the group X, wherein the X is represented by the formula $R_2$ is hydrogen, a branched or linear alkyl group (e.g., a $C_1$-$C_{20}$ alkyl group), a branched or linear alkoxy group, a branched or linear unsaturated hydrocarbon group, an ether group, a cycloalkyl group (e.g., cyclohexyl group), or an aryl group (e.g., phenyl group, naphthyl group, stilbenyl group, or tolanyl group), with the proviso that when $R_1$ is naphthyl, $R_2$ is naphthyl; and $R_3$, $R_4$, $R_5$, $R_6$, $R_7$, $R_8$, $R_9$, and $R_{10}$ are, independently, hydrogen, halogen, hydroxy, thiol, nitro, nitrile, a branched or linear alkoxy group (e.g., a $C_1$-$C_{20}$ alkyl group), a branched or linear alkyl group (e.g., a $C_1$-$C_{20}$ alkyl group), a branched or linear unsaturated hydrocarbon group, an ester group (e.g. —$CO_2R$ group), an ether group, an amino group, a cycloalkyl group (e.g., cyclohexyl group), a heterocyclic group (e.g. pyrrolyl, tetrazolyl, indolyl, carbazolyl, triazolyl, imidazolyl, benzimidazolyl, indazolyl, or benzotriazolyl group), an aryl group (e.g., phenyl group, naphthyl group, stilbenyl group, or tolanyl group) or a part of cyclic or polycyclic ring;

a charge generating compound; and an electrically conductive substrate.

The organophotoreceptor may be provided in the form of a plate, a flexible belt, a flexible disk, a rigid drum, or a sheet around a rigid or compliant drum. In one embodiment, the organophotoreceptor includes: (a) a charge transport layer comprising the charge transport material(s) of the present invention and a polymeric binder; (b) a charge generating layer comprising the charge generating compound and a polymeric binder; and (c) the electrically conductive substrate. The charge transport layer may be intermediate between the charge generating layer and the electrically conductive substrate. Alternatively, the charge generating layer may be intermediate between the charge transport layer and the electrically conductive substrate.

In a second aspect, the invention features an electrophotographic imaging apparatus that includes (a) a plurality of support rollers; and (b) the above-described organophotoreceptor in the form of a flexible belt threaded around the support rollers. The apparatus preferably further includes a liquid toner dispenser.

In a third aspect, the invention features an electrophotographic imaging process that includes (a) applying an electrical charge to a surface of the above-described organophotoreceptor; (b) imagewise exposing the surface of the organophotoreceptor to radiation to dissipate charge in selected areas and thereby form a pattern of charged and uncharged areas on the surface; (c) contacting the surface with a liquid toner that includes a dispersion of colorant particles in an organic liquid to create a toned image; and (d) transferring the toned image to a substrate.

In a fourth aspect, the invention features a novel charge transport material having the formula (1) (as well as formulae I-X) according to the invention (1)

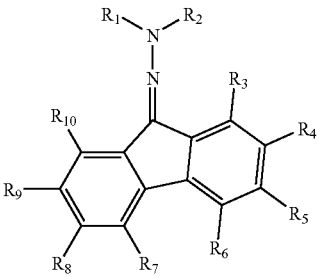

where $R_1$ is a heterocyclic group (e.g. sulfolanyl, pyrrolyl, pyrazolyl, tetrazolyl, indolyl, carbazolyl, triazolyl, imidazolyl, benzimidazolyl, indazolyl, or benzotriazolyl group), naphthyl group, alkylsulfonylphenyl, stilbenyl, or the group X, wherein X is represented by the formula

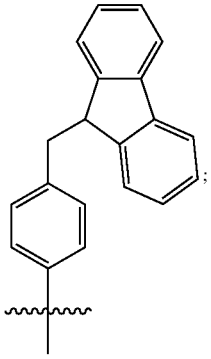

$R_2$ is hydrogen, a branched or linear alkyl group (e.g., a $C_1$-$C_{20}$ alkyl group), a branched or linear alkoxy group, a branched or linear unsaturated hydrocarbon group, an ether group, a cycloalkyl group (e.g., cyclohexyl group), or an aryl group (e.g., phenyl group, naphthyl group, stilbenyl group, or tolanyl group), with the proviso that when $R_1$ is naphthyl, $R_2$ is naphthyl; and $R_3$, $R_4$, $R_5$, $R_6$, $R_7$, $R_8$, $R_9$, and $R_{10}$ are, independently, hydrogen, halogen, hydroxy, thiol, nitro, nitrile, a branched or linear alkoxy group (e.g., a $C_1$-$C_{20}$ alkyl group), a branched or linear alkyl group (e.g., a $C_1$-$C_{20}$ alkyl group), a branched or linear unsaturated hydrocarbon group, an ester group (e.g. —$CO_2R$ group), an ether group, an amino group, a cycloalkyl group (e.g., cyclohexyl group), a heterocyclic group (e.g. pyrrolyl, tetrazolyl, indolyl, carbazolyl, triazolyl, imidazolyl, benzimidazolyl, indazolyl, or benzotriazolyl group), an aryl group (e.g., phenyl group, naphthyl group, stilbenyl group, or tolanyl group), or a part of cyclic or polycyclic ring.

In one embodiment, a charge transport material is selected in which $R_1$ is sulfolanyl group; $R_2$ is phenyl group, and $R_3$, $R_4$, $R_5$, $R_6$, $R_7$, $R_8$, $R_9$, and $R_{10}$ are, independently, hydrogen, halogen, hydroxy, thiol, nitro, nitrile, a branched or linear alkoxy group (e.g., a $C_1$-$C_{20}$ alkyl group), a branched or linear alkyl group (e.g., a $C_1$-$C_{20}$ alkyl group), a branched or linear unsaturated hydrocarbon group, an ester group (e.g. —$CO_2R$ group), an ether group, an amino group, a cycloalkyl group (e.g., cyclohexyl group), a heterocyclic group (e.g. pyrrolyl, tetrazolyl, indolyl, carbazolyl, triazolyl, imidazolyl, benzimidazolyl, indazolyl, or benzotriazolyl group), an aryl group (e.g., phenyl group, naphthyl group, stilbenyl group, or tolanyl group), or a part of cyclic or polycyclic ring.

Other features and advantages of the invention will be apparent from the following description of the preferred embodiments thereof, and from the claims.

DETAILED DESCRIPTION OF THE INVENTION

Organophotoreceptors suitable for use in electrophotography and, more specifically, to organophotoreceptors having novel charge transport materials comprise 9H-fluoren-9-one hydrazino substituted compounds. The invention includes compounds of the generic formula for the compounds of the present invention which may be represented by at least one compound having at least one central nucleus of the following formula or formulae I-X:

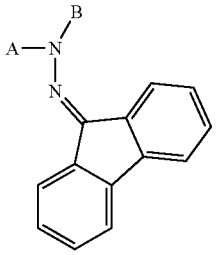

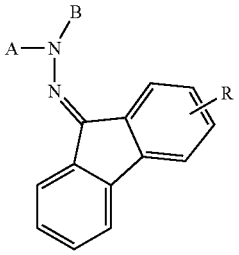

wherein A is selected from the group consisting of heterocyclic groups (e.g. sulfolanyl, pyrrolyl, pyrazolyl, tetrazolyl, indolyl, carbazolyl, triazolyl, imidazolyl, benzimidazolyl, indazolyl, or benzotriazolyl group), naphthyl group, alkylsulfonylphenyl, stilbenyl, and the group X, wherein X is represented by the formula

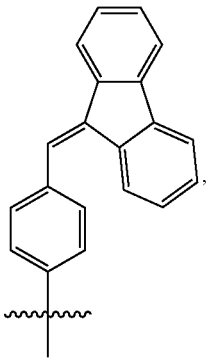

B is selected from the group consisting of hydrogen, alkyl group, and an aryl group (e.g., phenyl group, naphthyl group, stilbenyl group, or tolanyl group), and R is selected from the group consisting of hydrogen, a halogen, hydroxyl, thiol, nitro, nitrile, a branched of linear alkoxy group, a branched or linear alkyl group, a branched, cyclic or linear unsaturated hydrocarbon group, an ester group, an ether group, an amino group, a heterocyclic group, an aryl group, and a part of a cyclic of polycyclic ring, with the proviso that when A is naphthyl, B is naphthyl. It is preferred that heterocyclic groups have 5-, 6- or 7-member nucleus groups comprising C, N, S and O ring atoms, with no more than two atoms comprising S and/or O, nor more than two atoms selected from N and at least one of O or S, and no more than 4 N atoms (with no S or O present).

Substitution is liberally allowed on the groups and on the nucleus to effect various physical effects on the properties of the compounds, such as mobility, solubility, stability, and the like, as is known in the art.

Subgeneric formulae that represent subgroups of compounds within the practice of the present invention include the later presented formulae (I-X).

I. a charge transport material having the formula

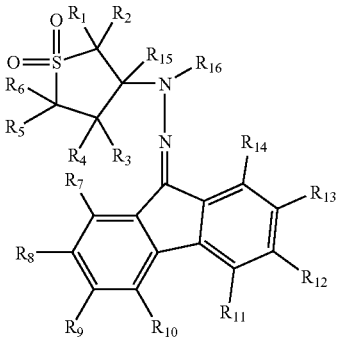

where $R_1$, $R_2$, $R_3$, $R_4$, $R_5$, $R_6$, $R_7$, $R_8$, $R_9$ $R_{10}$, $R_{11}$, $R_{12}$, $R_{13}$, $R_{14}$, and $R_{15}$ are, independently, hydrogen, halogen, hydroxy, thiol, nitro, nitrile, a branched or linear alkoxy group (e.g., a $C_1$-$C_{20}$ alkyl group), a branched or linear alkyl group (e.g., a $C_1$-$C_{20}$ alkyl group), a branched or linear unsaturated hydrocarbon group, an ether group, an ester group, an amino group, a cycloalkyl group (e.g. cyclohexyl group), a heterocyclic group (e.g. pyrrolyl, tetrazolyl, indolyl, carbazolyl, triazolyl, imidazolyl, benzimidazolyl, indazolyl, or benzotriazolyl group), an aryl group (e.g., phenyl group, naphthyl group, stilbenyl group, or tolanyl group), or a part of cyclic or polycyclic ring; and $R_{16}$ is an aryl group (e.g., phenyl group, naphthyl group, stilbenyl group, or tolanyl group) or a heterocyclic group (e.g. pyrrolyl, tetrazolyl, indolyl, carbazolyl, triazolyl, imidazolyl, benzimidazolyl, indazolyl, or benzotriazolyl group);

II. a charge transport material having the formula

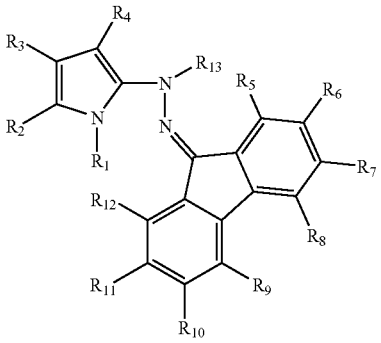

where $R_1$ is hydrogen, a branched or linear alkyl group (e.g., a $C_1$-$C_{20}$ alkyl group), a branched or linear alkoxy group, a branched or linear unsaturated hydrocarbon group, an ether group, a cycloalkyl group (e.g., cyclohexyl group), or an aryl group (e.g., phenyl group, naphthyl group, stilbenyl group, or tolanyl group);

$R_2$, $R_3$, $R_4$, $R_5$, $R_6$, $R_7$, $R_8$, $R_9$ $R_{10}$, $R_{11}$, and $R_{12}$ are, independently, hydrogen, halogen, hydroxy, thiol, nitro, nitrile, a branched or linear alkoxy group (e.g., a $C_1$-$C_{20}$ alkyl group), a branched or linear alkyl group (e.g., a $C_1$-$C_{20}$ alkyl group), a branched or linear unsaturated hydrocarbon group, an ester group, an ether group, an amino group, a cycloalkyl group (e.g. cyclohexyl group), a heterocyclic group (e.g. sulfolanyl, pyrrolyl, pyrazolyl, tetrazolyl, indolyl, carbazolyl, triazolyl, imidazolyl, benzimidazolyl, indazolyl, or benzotriazolyl group), an aryl group (e.g., phenyl group, naphthyl group, stilbenyl group, or tolanyl group), or a part of cyclic or polycyclic ring; and $R_{13}$ is an aryl group (e.g., phenyl group, naphthyl group, stilbenyl group, or tolanyl group) or a heterocyclic group (e.g. sulfolanyl, pyrrolyl, pyrazolyl, tetrazolyl, indolyl, carbazolyl, triazolyl, imidazolyl, benzimidazolyl, indazolyl, or benzotriazolyl group);

III. a charge transport material having the formula

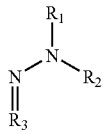

where $R_1$ and $R_2$ are naphthyl group and $R_3$ is 9-fluorenone or one of its derivatives;

IV. a charge transport material having the formula

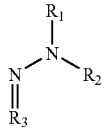

where $R_1$ is hydrogen, an alkyl group, or an aryl group (e.g., phenyl group, naphthyl group, stilbenyl group, or tolanyl group), $R_2$ is tetrazolyl or one of its derivatives, and $R_3$ is 9-fluorenone or one of its derivatives;

V. a charge transport material having the formula

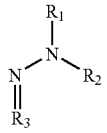

where $R_1$ is hydrogen, an alkyl group, or an aryl group (e.g., phenyl group, naphthyl group, stilbenyl group, or tolanyl group), $R_2$ is benzotriazolyl or one of its derivatives, and $R_3$ is 9-fluorenone or one of its derivatives;

VI. a charge transport material having the formula

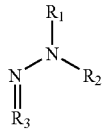

where $R_1$ is hydrogen, an alkyl group, or an aryl group (e.g., phenyl group, naphthyl group, stilbenyl group, or tolanyl group), $R_2$ is the group X, wherein X is represented by the formula

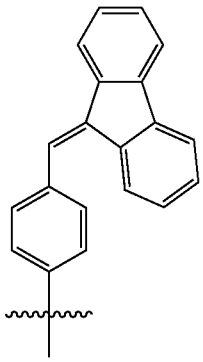

and $R_3$ is 9-fluorenone or one of its derivatives;

VII. a charge transport material having the formula

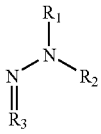

where $R_1$ is hydrogen, an alkyl group, or an aryl group (e.g., phenyl group, naphthyl group, stilbenyl group, or tolanyl group), $R_2$ is an alkylsulfonylphenyl or one of its derivatives, and $R_3$ is 9-fluorenone or one of its derivatives;

VIII. a charge transport material having the formula

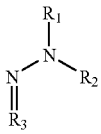

where $R_1$ is hydrogen, an alkyl group, or an aryl group (e.g., phenyl group, naphthyl group, stilbenyl group, or tolanyl group), $R_2$ is stilbenyl or one of its derivatives, and $R_3$ is 9-fluorenone or one of its derivatives; and IX. a charge transport material having the formula

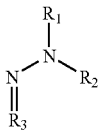

where $R_1$ is hydrogen, an alkyl group, or an aryl group (e.g., phenyl group, naphthyl group, stilbenyl group, or tolanyl group), $R_2$ is pyrazolyl or one of its derivatives, and $R_3$ is 9-fluorenone or one of its derivatives;

X. a charge transport material having the formula

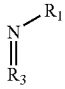

where $R_1$ is N-pyrrolyl, N-pyrazolyl, N-tetrazolyl, N-indolyl, N-carbazolyl, N-triazolyl, N-imidazolyl, N-benzimidazolyl, N-indazolyl, or N-benzotriazolyl group, and $R_3$ is 9-fluorenone or one of its derivatives.

Non-limiting examples of such charge transport materials according to Formula I have the following structures.

(2)

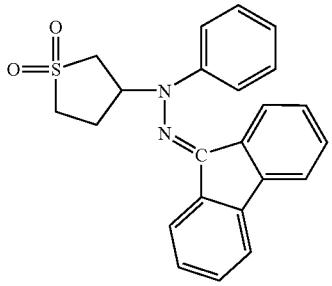

(3)

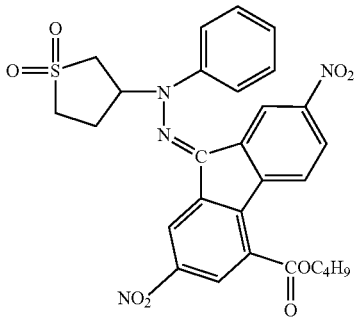

(4)

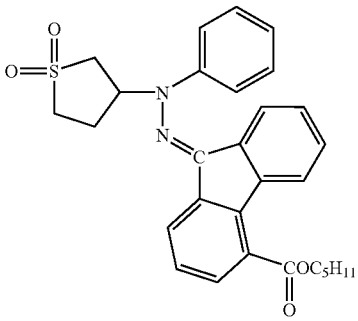

(5)

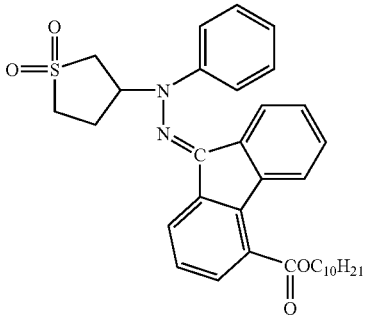

-continued
(6)
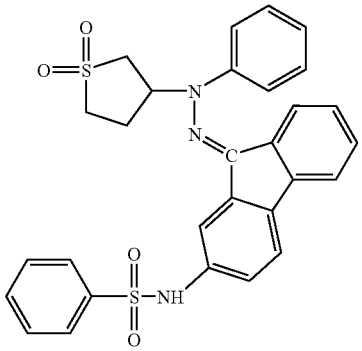
(7)
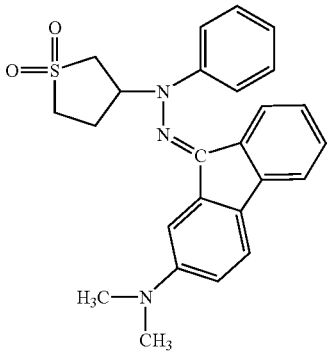
Non-limiting examples of such charge transport materials according to Formula II have the following structures.
(8)
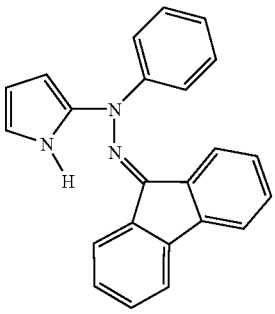
(9)
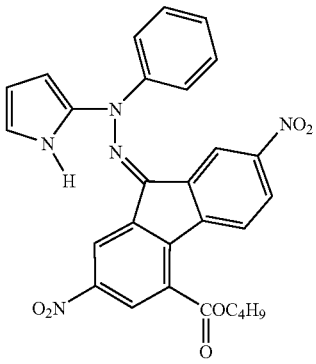
-continued
(10)
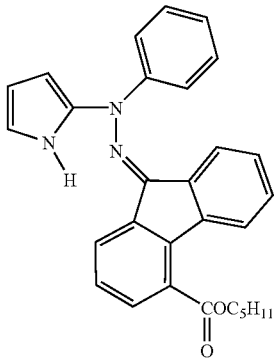
(11)
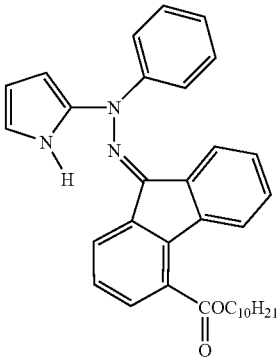
(12)
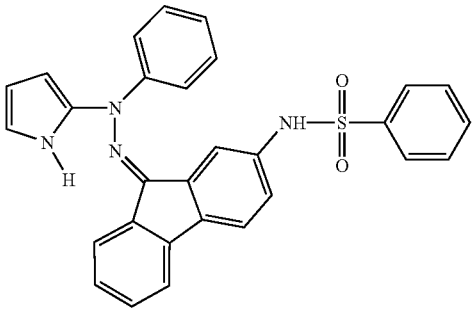
(13)
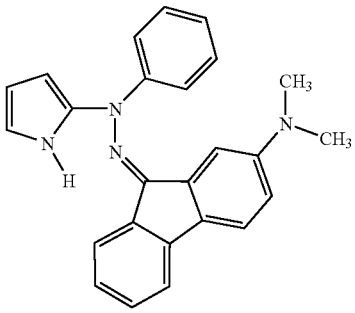

Specific examples of suitable charge transport materials of this invention according to Formula III have the following structures.

(14)

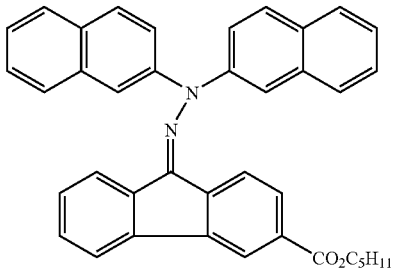

(15)

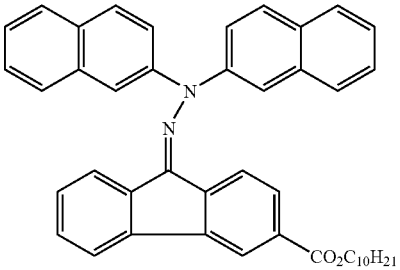

Specific examples of suitable charge transport materials of this invention according to formula IV have the following structures.

(16)

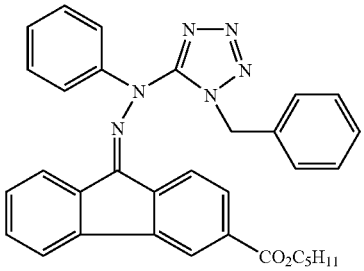

(17)

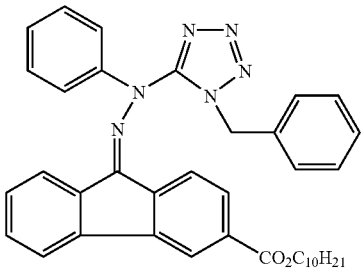

Specific examples of suitable charge transport materials of this invention according to Formula V have the following structures.

(18)

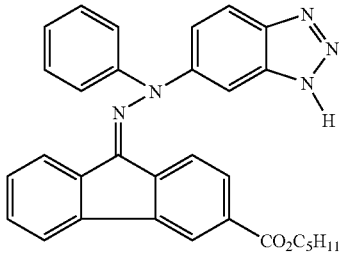

(19)

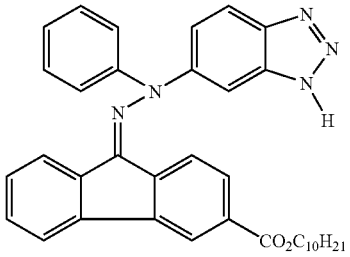

Specific examples of suitable charge transport materials of this invention according to Formula VI have the following structures.

(20)

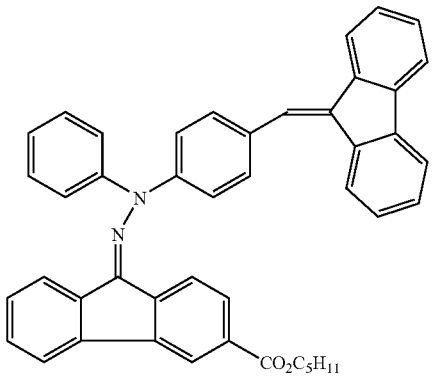

(21)

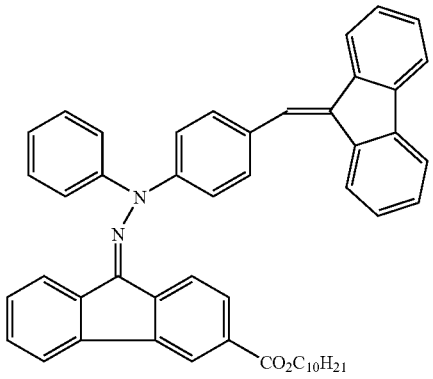

Specific examples of suitable charge transport materials of this invention according to Formula VII have the following structures.

(22)

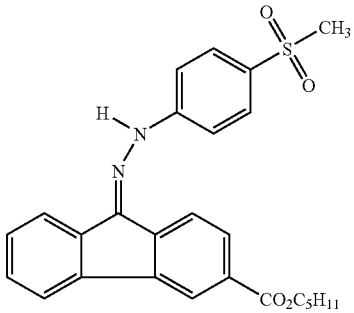

(23)

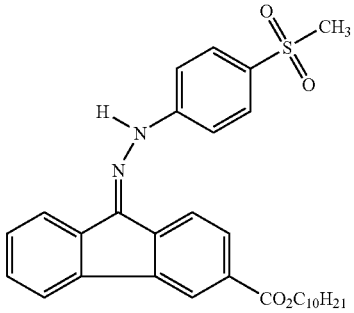

Specific examples of suitable charge transport materials of this invention according to claim VIII have the following structures.

(24)

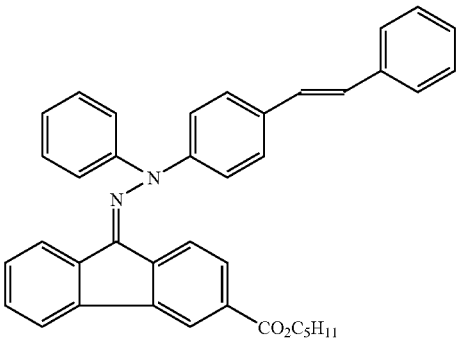

(25)

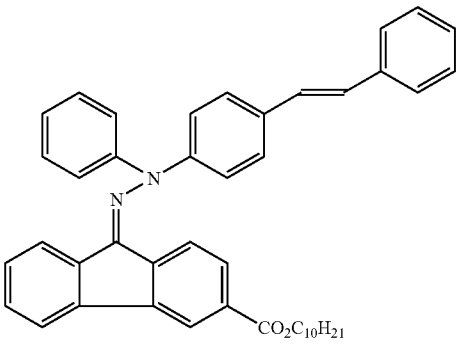

Specific examples of suitable charge transport materials of this invention according to Formula IX have the following structures.

(26)

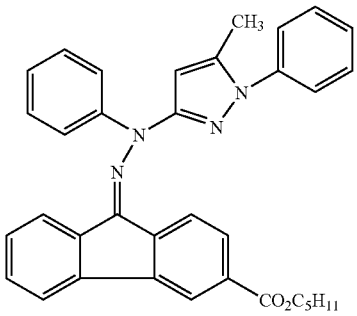

(27)

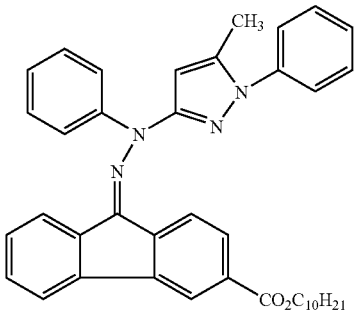

A specific example of suitable charge transport materials of this invention according to Formula X has the following structure.

(28)

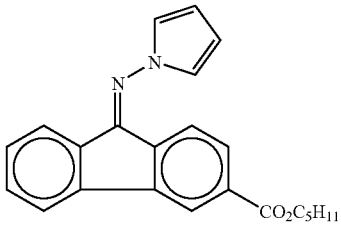

The invention features organophotoreceptors that include charge transport materials having the formulae set forth in the Summary of the Invention above. The charge transport materials according to Formulae (I-X) may be prepared by the reaction of the corresponding hydrazine with 9H-fluoren-9-one or its derivatives by refluxing the reactants in tetrahydrofuran for a sufficient period of time and with minor variations according to the skill of the artisan, as shown in the examples below.

The organophotoreceptor may be in the form of a plate, drum, disk, a sheet, belt, or a sheet around a rigid or compliance drum. The organophotoreceptor may include an electrically conductive substrate and a photoconductive element in the form of a single layer that includes both the charge transport compound and charge generating compound in a polymeric binder. The organophotoreceptor may also includes an electrically conductive substrate and a photoconductive element that is a bilayer construction featuring a charge generating layer and a separate charge transport layer. The charge generating layer may be located intermediate between the electrically conductive substrate and the charge transport layer. Alternatively, the photoconductive element may be an inverted construction in which the charge transport layer is intermediate between the electrically conductive substrate and the charge generating layer.

The electrically conductive substrate may be flexible, for example in the form of a flexible web or a belt, or inflexible, for example in the form of a drum. Typically, a flexible electrically conductive substrate comprises of an insulated substrate and a thin layer of electrically conductive materials. The insulated substrate may be paper or a film forming polymer such as polyethylene terephthalate, polyimide, polysulfone, polyethylene naphthalate, polypropylene, nylon, polyester, polycarbonate, polyvinyl fluoride, polystyrene and the like. Specific examples of supporting substrates included polyethersulfone (STABAR™ S-100, available from ICI), polyvinyl fluoride (TEDLAR™, available from E. I. DuPont de Nemours & Company), polybisphenol-A polycarbonate (MACROFOL™, available from Mobay Chemical Company) and amorphous polyethylene terephthalate (MELINAR™, available from ICI Americas, Inc.). The electrically conductive materials may be graphite, dispersed carbon black, iodide, conductive polymers such as polypyroles and CALGON® Conductive polymer 261 (commercially available from Calgon Corporation, Inc., Pittsburgh, Pa.), metals such as aluminum, titanium, chromium, brass, gold, copper, palladium, nickel, or stainless steel, or metal oxide such as tin oxide or indium oxide. Preferably, the electrically conductive material is aluminum. Typically, the photoconductor substrate will have a thickness adequate to provide the required mechanical stability. For example, flexible web substrates generally have a thickness from about 0.01 to about 1 mm, while drum substrates generally have a thickness of from about 0.5 mm to about 2 mm.

The charge generating compound is a material which is capable of absorbing light to generate charge carriers, such as a dyestuff or pigment. Examples of suitable charge generating compounds include metal-free phthalocyanines (e.g., CGM-X01 x-form metal-free phthalocyanine from Sanyo Color Works, Ltd.), metal phthalocyanines such as titanium phthalocyanine, copper phthalocyanine, oxytitanium phthalocyanine, hydroxygallium phthalocyanine, squarylium dyes and pigments, hydroxy-substituted squarylium pigments, perylimides, polynuclear quinones available from Allied Chemical Corporation under the trade name INDOFAST™ Double Scarlet, INDOFAST™ Violet Lake B, INDOFAST™ Brilliant Scarlet and INDOFAST™ Orange, quinacridones available from DuPont under the trade name MONASTRAL™ Red, MONASTRAL™ Violet and MONASTRAL™ Red Y, naphthalene 1,4,5,8-tetracarboxylic acid derived pigments including the perinones, tetrabenzoporphyrins and tetranaphthaloporphyrins, indigo- and thioindigo dyes, benzothioxanthene-derivatives, perylene 3,4,9,10-tetracarboxylic acid derived pigments, polyazo-pigments including bisazo-, trisazo- and tetrakisazo-pigments, polymethine dyes, dyes containing quinazoline groups, tertiary amines, amorphous selenium, selenium alloys such as selenium-tellurium, selenium-tellurium-arsenic and selenium-arsenic, cadmium sulphoselenide, cadmiumselenide, cadmium sulfide, and mixtures thereof. Preferably, the charge generating compound is oxytitanium phthalocyanine, hydroxygallium phthalocyanine or a combination thereof.

Preferably, the charge generating compound is oxytitanium phthalocyanine, hydroxygallium phthalocyanine or a combination thereof.

The binder is capable of dispersing or dissolving the charge transport material of this invention and the charge generating compound. Examples of suitable binders include polystyrene-co-butadiene, modified acrylic polymers, polyvinyl acetate, styrene-alkyd resins, soya-alkyl resins, polyvinylchloride, polyvinylidene chloride, polyacrylonitrile, polycarbonates, polyacrylic acid, polyacrylates, polymethacrylates, styrene polymers, polyvinyl butyral, alkyd resins, polyamides, polyurethanes, polyesters, polysulfones, polyethers, polyketones, phenoxy resins, epoxy resins, silicone resins, polysiloxanes, poly(hydroxyether) resins, polyhydroxystyrene resins, novolak resins, resol resins, poly(phenylglycidyl ether)-co-dicyclopentadiene, copolymers of monomers used in the above-mentioned polymers, and combinations thereof. Polycarbonate binders are particularly preferred. Examples of suitable polycarbonate binders include polycarbonate A which is derived from bisphenol-A, polycarbonate Z, which is derived from cyclohexylidene bisphenol, polycarbonate C, which is derived from methylbisphenol A, and polyestercarbonates.

If a particular charge transport material of this invention works as a charge transport compound, preferably, the organophotoreceptor of this invention contains an electron transport compound. Non-limiting examples of suitable electron transport compound include bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno4H-indeno[1,2-b]thiophene-4-one, and 1,3,7-trinitrodibenzothiophene-5,5-dioxide, (2,3-diphenyl-1-indenylidene)malononitrile, 4H-thiopyran-1,1-dioxide and its derivatives such as 4-dicyanomethylene-2,6-diphenyl-4H-thiopyran-1,1-dioxide, 4-dicyanomethylene-2,6-di-m-tolyl-4H-thiopyran-1,1-dioxide, and unsymmetrically substituted 2,6-diaryl-4H-thiopyran-1,1-dioxide such as 4H-1,1-dioxo-2-(p-isopropylphenyl)-6-phenyl-4-(dicyanomethylidene)thiopyran and 4H-1,1-dioxo-2-(p-isopropylphenyl)-6-(2-thienyl)-4-(dicyanomethylidene)thiopyran, derivatives of phospha-2,5-cyclohexadiene, alkoxycarbonyl-9-fluorenylidene)malononitrile derivatives such as (4-n-butoxycarbonyl-9-fluorenylidene)malononitrile, (4-phenethoxycarbonyl-9-fluorenylidene)malononitrile, (4-carbitoxy-9-fluorenylidene)malononitrile, and diethyl(4-n-butoxycarbonyl-2,7-dinitro-9-fluorenylidene)-malonate, anthraquinodimethane derivatives such as 11,11,12,12-tetracyano-2-alkylanthraquinodimethane and 11,11-dicyano-12,12-bis(ethoxycarbonyl)anthraquinodimethane, anthrone derivatives such as 1-chloro-10-[bis(ethoxycarbonyl)methylene]anthrone, 1,8-dichloro-10-[bis(ethoxycarbonyl)methylene]anthrone, 1,8-dihydroxy-10-[bis(ethoxycarbonyl)methylene]anthrone, and 1-cyano-10-[bis(ethoxycarbonyl)methylene)anthrone, 7-nitro-2-aza-9-fluroenylidene-malononitrile, diphenoquinone derivatives, benzoquinone derivatives, naphtoquinone derivatives, quinine derivatives, tetracyanoethylenecyanoethylene, 2,4,8-trinitrothioxantone, dinitrobenzene derivatives, dinitroanthracene derivatives, dinitroacridine derivatives, nitroanthraquinone derivatives, dinitroanthraquinone derivatives, succinic anhydride, maleic anhydride, dibromo maleic anhydride, pyrene derivatives, carbazole derivatives, hydrazone derivatives, N,N-dialkylaniline derivatives, diphenylamine derivatives, triphenylamine derivatives, triphenylmethane derivatives, tetracyanoquinoedimethane, 2,4,5,7-tetranitro-9-fluorenone, 5 2,4,7-trinitro-9-dicyanomethylenefluorenone, 2,4,5,7-tetranitroxanthone derivatives, and 2,4,8-trinitrothioxanthone derivatives.

If a particular charge transport material of this invention works as an electron transport compound, preferably, the organophotoreceptor of this invention contains an charge transport compound. Suitable charge transport compound include, but are not limited to, pyrazoline derivatives, fluorene derivatives, oxadiazole derivatives, stilbene derivatives, hydrazone derivatives, carbazole hydrazone derivatives, triaryl amines, polyvinyl carbazole, polyvinyl pyrene, polyacenaphthylene, or multi-hydrazone compounds comprising at least two hydrazone groups and at least two groups selected from the group consisting of triphenylamine and heterocycles such as carbazole, julolidine, phenothiazine, phenazine, phenoxazine, phenoxathiin, thiazole, oxazole, isoxazole, dibenzo(1,4)dioxine, thianthrene, imidazole, benzothiazole, benzotriazole, benzoxazole, benzimidazole, quinoline, isoquinoline, quinoxaline, indole, indazole, pyrrole, purine, pyridine, pyridazine, pyrimidine, pyrazine, triazole, oxadiazole, tetrazole, thiadiazole, benzisoxazole, benzisothiazole, dibenzofuran, dibenzothiophene, thiophene, thianaphthene, quinazoline, or cinnoline. Preferably, the charge transport compound is an enamine stilbene compound such as MPCT-10, MPCT-38, and MPCT-46 from Mitsubishi Paper Mills (Tokyo, Japan).

For the multiple layer photoconductive elements, the charge generation layer comprises a binder in an amount of from about 10 to about 90 weight percent and preferably in an amount of from about 20 to about 75 weight percent, based on the weight of the charge generation layer. The charge transport layer typically comprises a charge transport compound in an amount of from about 25 to about 60 weight percent, based on the weight of the charge transport layer, and more preferably in an amount of from about 35 to about 50 weight percent, based on the weight of the charge transport layer, with the remainder of the charge transport layer comprising the binder, and optionally any conventional additives. The charge transport layer will typically have a thickness of from about 10 to about 40 microns and may be formed in accordance with any conventional technique known in the art.

For the single layer photoconductive elements, the charge generation compound is in an amount of from about 0.5 to about 20 weight percent and more preferably in an amount of from about 1 to about 10 weight percent, based on the weight of the photoconductive layer. The charge transport compound is in an amount of from about 10 to about 80 weight percent, based on the weight of the photoconductive layer, and more preferably in an amount of from about 40 to about 60 weight percent, based on the weight of the photoconductive layer. The electron transport compound is in an amount of from about 2.5 to about 25 weight percent, based on the weight of the photoconductive layer, and more preferably in an amount of from about 4 to about 20 weight percent, based on the weight of the photoconductive layer. The binder is in an amount of from about 15 to about 80 weight percent, based on the weight of the photoconductive layer, and more preferably in an amount of from about 20 to about 50 weight percent, based on the weight of the photoconductive layer.

Optionally, the organophotoreceptor of this invention, independently, may contain a light stabilizer. Non-limiting examples of suitable light stabilizer include hindered trialkylamines such as TINUVIN® 292 (from Ciba Specialty Chemicals, Terrytown, N.Y.), hindered alkoxydialkylamines such as TINUVIN® 123 (from Ciba Specialty Chemicals), benzotriazoles such as TINUVIN® 928 (from Ciba Specialty Chemicals), benzophenones, nickel compounds such as ARBESTAB™ (from Robinson Brothers Ltd, West Midlands, Great Britain), salicylates, cyanocinnamates, benzylidene malonates, benzoates, oxanilides, polymeric sterically hindered amines such as LUCHEM™ (from Atochem North America, Buffalo, N.Y.). Preferably, the light stabilizer is selected from the group consisting of hindered trialkylamines having the following formula:

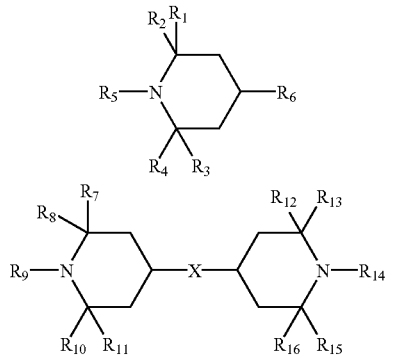

where $R_1$, $R_2$, $R_3$, $R_4$, $R_6$, $R_7$, $R_8$, $R_{10}$, $R_{11}$, $R_{12}$, $R_{13}$, $R_{14}$, $R_{15}$ are, independently, hydrogen, alkyl group, or ester, or ether group; and $R_5$, $R_9$, and $R_{14}$ are, independently, alkyl group; and X is a linking group selected from the group consisting of —O—CO—$(CH_2)_m$—CO—O— where m is between 2 to 20.

The light stabilizer in the photoconductive layer is in an amount of from about 0.5 to about 25 weight percent and more preferably in an amount of from about 1 to about 10 weight percent, based on the weight of the photoconductive layer.

Conveniently, the photoconductive layer may be formed by dispersing or dissolving the components such as a charge generating compound, a charge transport compound, a light stabilizer, an electron transport compound, and a polymeric binder in organic solvent, coating the dispersion and/or solution on the respective underlying layer and drying the coating. Preferably, the components are dispersed by high shear homogenization, ball-milling, attritor milling, high energy bead (sand) milling or other size reduction processes or mixing means known in the art for effecting particle size reduction in forming a dispersion.

The photoreceptor may include additional layers as well. Such layers are well-known and include, for example, barrier layers, release layers, adhesive layer, and sub-layer. The release layer forms the uppermost layer of the photoconductor element with the barrier layer sandwiched between the release layer and the photoconductive element. The adhesive layer locates and improves the adhesion between the barrier layer and the release layer. The sub-layer is a charge blocking layer and locates between the electrically conductive substrate and the photoconductive element. The sub-layer may also improve the adhesion between the electrically conductive substrate and the photoconductive element.

Suitable barrier layers include coatings such as crosslinkable siloxanol-colloidal silica coating and hydroxylated silsesquioxane-colloidal silica coating, and organic binders such as polyvinyl alcohol, methyl vinyl ether/maleic anhydride copolymer, casein, polyvinyl pyrrolidone, polyacrylic acid, gelatin, starch, polyurethanes, polyimides, polyesters, polyamides, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers, and mixtures thereof. The above organic binders optionally may contain small inorganic particles such as fumed silica, silica, titania, alumina, zirconia, or a combination thereof. The typical particle size is in the range of 0.001 to 0.5 micrometers, preferably 0.005 micrometers. A preferred barrier layer is a 1:1 mixture of methyl cellulose and methyl vinyl ether/maleic anhydride copolymer with glyoxal as a crosslinker.

The release layer topcoat may comprise any release layer composition known in the art. Preferably, the release layer is a fluorinated polymer, siloxane polymer or silicone polymer, fluorosilicone polymer, silane, polyethylene, polypropylene, polyacrylate, or a combination thereof. More preferably, the release layer is selected from the group consisting of crosslinked silicone polymers and crosslinked fluorosilicone polymers.

Typical adhesive layers include film forming polymers such as polyester, polyvinylbutyral, polyvinylpyrolidone, polyurethane, polymethyl methacrylate, poly(hydroxy amino ether) and the like. Preferably, the adhesive layer is poly (hydroxy amino ether). If such layers are utilized, they preferably have a dry thickness between about 0.01 micrometer and about 5 micrometers.

Typical sub-layers include polyvinylbutyral, organosilanes, hydrolyzable silanes, epoxy resins, polyesters, polyamides, polyurethanes, silicones and the like. Preferably, the sub-layer has a dry thickness between about 20 Angstroms and about 2,000 Angstroms.

The charge transport materials, and photoreceptors including these materials, are suitable for use in an imaging process with either dry or liquid toner development. Liquid toner development is generally preferred because it offers the advantages of providing higher resolution images and requiring lower energy for image fixing compared to dry toners. Examples of useful liquid toners are well-known. They typically include a colorant, a resin binder, a charge director, and a carrier liquid. A preferred resin to pigment ratio is 2:1 to 10:1, more preferably 4:1 to 8:1. Typically, the colorant, resin, and the charge director form the toner particles.

The invention will now be described further by way of the following examples.

EXAMPLES

A. Synthesis in Accordance with Formula I

N-Phenyl-N-sulfolan-3-ylhydrazine

N-Phenyl-N-sulfolan-3-ylhydrazine can be prepared according to the procedure described in Great Britain Patent No. 1,047,525 by Mason, which is incorporated herein by reference. To a mixture of 0.5 mole of butadiene sulfone (commercially available from Aldrich, Milwaukee, Wis.) and 0.55 mole of phenylhydrazine (commercially available from Aldrich, Milwaukee, Wis.) was added 0.005 mole 40% aqueous potassium hydroxide solution. The mixture was kept for 2 hours at 60° C. whereupon a solid separated. After 10 hours the solid was filtered off to give N-phenyl-N-sulfolan-3-ylhydrazine (53%) having a melting point of 119-20° C. (MeOH): $^{1}$H-NMR in CDCl3, chemical shifts in ppm: 2.34-2.63 (m, 2H), 3.05-3.15 (m, 1H), 3.22-3.49 (m, 3H), 3.57 (s, 2H), 4.67 (quin, J=7.8 Hz, 1H), 6.88-6.97 (m, 3H)), 7.27-7.36 (m, 2H). $^{13}$C-NMR in CDCl3, chemical shifts in ppm: 26.0, 51.2, 51.4, 56.5, 113.8, 120.3, 129.6, 150.4

N-(2-Naphthyl)-N-sulfolan-3-ylhydrazine

N-(2-Naphthyl)-N-sulfolan-3-ylhydrazine can be prepared according to the procedure for N-phenyl-N-sulfolan-3-ylhydrazine except phenylhydrazine is replaced with 2-naphthylhydrazine. 2-Naphthylhydrazine can be prepared according to the procedure described in Chinese Patent No. 1,175,571 by Su et el., which is incorporated herein by reference. 2-Naphthylhydrazine can also be prepared by neutralizing 2-naphthylhydrazine hydrochloride with potassium hydroxide, which is commercially available from Apin Chemical Ltd. (UK), 82C Milton Park, Abingdon, Oxon, OX14 4RY, United Kingdom. (Web: http://www.apinchemicals.com.)

To a mixture of 0.5 mole of butadiene sulfone (commercially available from Aldrich, Milwaukee, Wis.) and 0.55 mole of 2-naphthylhydrazine is added 0.005 mole 40% aqueous potassium hydroxide solution. The mixture is kept for 16 hours at 60° C. N-(2-Naphthyl)-N-sulfolan-3-ylhydrazine is isolated and purified.

9-Fluorenone-4-carboxylic Acid Pentyl Ester

9-Fluorenone-4-carbonyl chloride (2.44 g, 10 mmol) was refluxed overnight with an excess of n-amyl alcohol (5 mL). The solvent was evaporated and dried in vacuum to give 80% of the crude product XII. The compound was recrystallized using ethyl acetate to give yellow plates; yield 74%; mp 37.9-38.1° C.; $^{1}$H-NMR in CDCl3, chemical shifts in ppm: 0.94 (t, J=7.5 Hz, 3H), 1.39-1.47 (m, 4H), 1.82 (quin, J=7.2 Hz, 2H), 4.40 (t, J=6.6 Hz, 2H), 7.31-7.36 (m, 2H), 7.52-7.55 (m, 1H), 7.68-7.70 (m, 1H), 7.79-7.82 (m, 1H), 7.92 (dd, J=7.8 Hz, 1H), 8.27 (d, J=7.8 Hz, 1H). $^{13}$C-NMR in CDCl3, chemical shifts in ppm: 13.9, 22.3, 28.1, 28.3, 65.7, 124.0, 126.1, 127.0, 127.2, 128.5, 129.6, 134.3, 135.0, 135.4, 135.9, 143.1, 143.8, 166.7, 192.8.

9-fluorenone-4-carboxylic Acid Decyl Ester 9-fluorenone-4-carboxylic acid decyl ester may be prepared similarly according to the preparation procedure for 9-fluorenone-4-carboxylic acid pentyl ester except n-amyl alcohol is replace by n-decanol.

Compound (2)

A mixture of 9-fluorenone (1.80 g, 0.01 mole, commercially available from Aldrich, Milwaukee, Wis.) and N-phenyl-N-sulfolan-3-ylhydrazine (2.26 g, 0.01 mole) is refluxed in tetrahydrofuran (20 ml) for 16 hours with stirring. Upon removal of the solvent, Compound (2) is isolated and purified by recrystallization.

Compound (3)

A mixture of 2,7-dinitro-9-oxo-9H-fluorene-4-carboxylic acid butyl ester (3.70 g, 0.01 mole, commercially available from Aldrich, Milwaukee, Wis.) and N-phenyl-N-sulfolan-3-ylhydrazine (2.26 g, 0.01 mole) is refluxed in tetrahydrofuran (20 ml) for 16 hours with stirring. Upon removal of the solvent, Compound (3) is isolated and purified by recrystallization.

Compound (4)

A mixture of N-phenyl-N-sulfolan-3-ylhydrazine (0.23 g, 1 mmol) and 9-fluorenone-4-carboxylic acid pentyl ester (3.5 g, 1.2 mmol) were dissolved in 20 mL of THF and 2-3 drops of concentrated sulfuric acid was added. The reaction mixture was refluxed for 5 h and then cooled to room temperature. The solvent was removed in vacuo to give yellow oil. Compound (4) was purified by column chromatography on silica gel using 75% ether in pentane. Orange flakes; yield 40%; mp 88.9-90.4° C.; $^{1}$H NMR and $^{13}$C NMR: H-NMR in CDCl3, chemical shifts in ppm: 0.90-0.96 (m, 3H), 1.39-1.46 (m, 4H), 1.77-1.86 (m, 2H), 2.55-2.69 (m, 2H), 3.08-3.17 (m, 1H), 3.24-3.31 (m, 1H), 3.49-3.58 (m, 1H), 3.79-3.86 (m, 1H), 4.37-4.43 (m, 1H), 4.72-4.80 (m, 1H), 6.97-7.08 (m, 4H), 7.22-7.32 (m, 3H), 7.38-7.43 (m, 1H), 7.50-7.86 (m, 2H), 8.04-8.12 (m, 1H), 8.22 (t, J=8.1 Hz, 1H).

Compound (5)

A mixture of 9-fluorenone-4-carboxylic acid decyl ester (3.64 g, 0.01 mole) and N-phenyl-N-sulfolan-3-ylhydrazine (2.26 g, 0.01 mole) is refluxed in tetrahydrofuran (20 ml) for 16 hours with stirring. Upon removal of the solvent, Compound (5) is isolated and purified by recrystallization.

Compound (6)

A mixture of 2-(para-toluenesulfonamido)-9-fluorenone (3.49 g, 0.01 mole, commercially available from Aldrich, Milwaukee, Wis.) and N-phenyl-N-sulfolan-3-ylhydrazine (2.26 g, 0.01 mole) is refluxed in tetrahydrofuran (20 ml) for 16 hours with stirring. Upon removal of the solvent, Compound (6) is isolated and purified by recrystallization.

Compound (7)

A mixture of 2-dimethylamino-9-fluorenone (2.23 g, 0.01 mole, commercially available from Aldrich, Milwaukee, Wis.) and N-phenyl-N-sulfolan-3-ylhydrazine (2.26 g, 0.01 mole) is refluxed in tetrahydrofuran (20 ml) for 16 hours with stirring. Upon removal of the solvent, Compound (7) is isolated and purified by recrystallization.

B. Synthesis in Accordance with Formula II

N-Pyrrol-2-yl-N-phenylhydrazine

N-Pyrrol-2-yl-N-phenylhydrazine can be prepared according to the procedure described in Japanese Patent No. 05148210 by Myamoto, which is incorporated herein by reference.

Compound (8)

A mixture of 9-fluorenone (1.80 g, 0.01 mole, commercially available from Aldrich, Milwaukee, Wis.) and N-pyrrol-2-yl-N-phenylhydrazine (1.73 g, 0.01 mole) is refluxed in tetrahydrofuran (20 ml) for 16 hours with stirring. Upon removal of the solvent, Compound (8) is isolated and purified by recrystallization.

Compound (9)

A mixture of 2,7-dinitro-9-oxo-9H-fluorene-4-carboxylic acid butyl ester (3.70 g, 0.01 mole, commercially available from Aldrich, Milwaukee, Wis.) and N-pyrrol-2-yl-N-phenylhydrazine (1.73 g, 0.01 mole) is refluxed in tetrahydrofuran (20 ml) for 16 hours with stirring. Upon removal of the solvent, Compound (9) is isolated and purified by recrystallization.

Compound (10)

A mixture of 9-fluorenone-4-carboxylic acid pentyl ester (2.94 g, 0.01 mole) and N-pyrrol-2-yl-N-phenylhydrazine (1.73 g, 0.01 mole) is refluxed in tetrahydrofuran (20 ml) for 16 hours with stirring. Upon removal of the solvent, Compound (10) is isolated and purified by recrystallization.

Compound (11)

A mixture of 9-fluorenone-4-carboxylic acid decyl ester (3.64 g, 0.01 mole) and N-pyrrol-2-yl-N-phenylhydrazine (1.73 g, 0.01 mole) is refluxed in tetrahydrofuran (20 ml) for 16 hours with stirring. Upon removal of the solvent, Compound (11) is isolated and purified by recrystallization.

Compound (12)

A mixture of 2-(para-toluenesulfonamido)-9-fluorenone (3.49 g, 0.01 mole, commercially available from Aldrich, Milwaukee, Wis.) and N-pyrrol-2-yl-N-phenylhydrazine (1.73 g, 0.01 mole) is refluxed in tetrahydrofuran (20 ml) for 16 hours with stirring. Upon removal of the solvent, Compound (12) is isolated and purified by recrystallization.

Compound (13)

A mixture of 2-dimethylamino-9-fluorenone (2.23 g, 0.01 mole, commercially available from Aldrich, Milwaukee, Wis.) and N-pyrrol-2-yl-N-phenylhydrazine (1.73 g, 0.01 mole) is refluxed in tetrahydrofuran (20 ml) for 16 hours with stirring. Upon removal of the solvent, Compound (13) is isolated and purified by recrystallization.

C. Synthesis According to Formula III 1,1-Dinaphthylhydrazine 1,1-Dinaphthylhydrazine can be prepared according to the procedure described in *Journal of the General Chemistry* (1964), 34, 136 by Staschkow et el., which is incorporated herein by reference.

A suspension of 0.07 mole of the naphthyl nitrosamine in 750 ml of ether was cooled to 5-8° C. and treated with 150 g of zinc dust. 70 ml of acetic acid was then added drop wise with stirring. To complete the reaction, 40 g of zinc dust was added. The reaction mixture was heated and filtered from the sludge. The mother liquor was washed with 10% sodium carbonate solution and dried with solid KOH. The ether was distilled off to give the crystalline hydrazines, which was crystallized from ethanol or butanol.

Compound (14)

9-Fluorenone-4-carboxylic acid pentyl ester (2.94 g, 0.01 mole) and 1,1-Dinaphthylhydrazine (2.86 g, 0.01 mole) in a molar ratio of 1:1 is refluxed in tetrahydrofuran (20 ml) for 16 hours with stirring. Upon removal of the solvent, the crude Compound (14) is isolated and purified by recrystallization.

Compound (15)

9-Fluorenone-4-carboxylic acid decyl ester (3.64 g, 0.01 mole) and 1,1-Dinaphthylhydrazine (2.86 g, 0.01 mole) in a molar ratio of 1:1 is refluxed in tetrahydrofuran (20 ml) for 16 hours with stirring. Upon removal of the solvent, the crude Compound (15) is isolated and purified by recrystallization.

D. Synthesis According to Formula IV

1-Phenyl-1-(1-benzyl-1H-tetrazol-5-yl)hydrazine

1-Phenyl-1-(1-benzyl-1H-tetrazol-5-yl)hydrazine can be prepared according to the procedure described in Tetrahedron (1983), 39(15), 2599-608 by Atherton et el., which is incorporated herein by reference.

Compound (16)

9-Fluorenone-4-carboxylic acid pentyl ester (2.94 g, 0.01 mole) and 1-phenyl-1-(1-benzyl-1H-tetrazol-5-yl)hydrazine (2.66 g, 0.01 mole) in a molar ratio of 1:1 is refluxed in tetrahydrofuran (20 ml) for 16 hours with stirring. Upon removal of the solvent, the crude Compound (16) is isolated and purified by recrystallization.

Compound (17)

9-Fluorenone-4-carboxylic acid decyl ester (3.64 g, 0.01 mole) and 1-phenyl-1-(1-benzyl-1H-tetrazol-5-yl)hydrazine (2.66 g, 0.01 mole) in a molar ratio of 1:1 is refluxed in tetrahydrofuran (20 ml) for 16 hours with stirring. Upon removal of the solvent, the crude Compound (17) is isolated and purified by recrystallization.

E. Synthesis According to Formula V

N-(5-Benzotriazolyl)-N-phenylhydrazine

N-(5-benzotriazolyl)-N-phenylhydrazine can be prepared according to the procedure described below. To a mixture of phenylhydrazine (97 g, 0.9 mole, commercially available from Aldrich, Milwaukee, Wis.) and 5-chlorobenzotriazole (15.4 g, 0.1 mole, commercially available from Aldrich, Milwaukee, Wis.) heated to boiling temperature, sodium is slowly added until there is no more discharge of red coloration. After boiling for some time the mixture is cooled to room temperature. The product is isolated and purified.

Compound (18)

9-Fluorenone-4-carboxylic acid pentyl ester (2.94 g, 0.01 mole) and N-(5-benzotriazolyl)-N-phenylhydrazine (2.25 g, 0.01 mole) in a molar ratio of 1:1 is refluxed in tetrahydrofuran (20 ml) for 16 hours with stirring. Upon removal of the solvent, the crude Compound (18) is isolated and purified by recrystallization.

Compound (19)

9-Fluorenone-4-carboxylic acid decyl ester (3.64 g, 0.01 mole) and N-(5-benzotriazolyl)-N-phenylhydrazine (2.25 g, 0.01 mole) in a molar ratio of 1:1 is refluxed in tetrahydrofuran (20 ml) for 16 hours with stirring. Upon removal of the solvent, the crude Compound (19) is isolated and purified by recrystallization.

F. Synthesis According to Formula VI

N-phenylhydrazine derivative

An N-phenylhydrazine derivative can be prepared according to the procedure similar to that described in Zh. Org. Khim. (1967), 3(9), 1605-3 by Matevosyan et el., which is incorporated herein by reference. To a mixture of phenylhydrazine (97 g, 0.9 mole, commercially available from Aldrich, Milwaukee, Wis.) and p-9-(4-chlorobenzylidene)fluorene (28.9 g, 0.1 mole, commercially available from from Aldrich, Milwaukee, Wis.) heated to boiling temperature, sodium was slowly added until there was no more discharge of red coloration. After boiling for some time the mixture was dissolved in 1750 ml of ethanol and cooled to −15° C. The precipitated product was recrystallized to give a hydrazine having the formula $H_2N—NR_1R_2$, wherein $R_1$ is phenyl and wherein $R_2$ is the group X, wherein X is represented by the structure

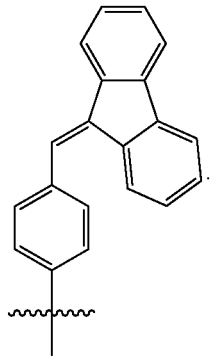

Compound (20)

9-Fluorenone-4-carboxylic acid pentyl ester (2.94 g, 0.01 mole) and a hydrazine having the formula $H_2N—NR_1R_2$, wherein $R_1$ is phenyl and wherein $R_2$ is the group X, wherein X is represented by the structure

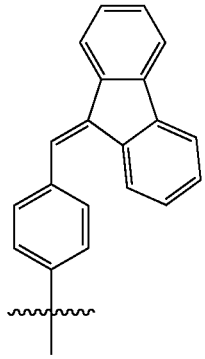

(3.6 g, 0.01 mole) in a molar ratio of 1:1 is refluxed in tetrahydrofuran (20 ml) for 16 hours with stirring. Upon removal of the solvent, the crude Compound (20) is isolated and purified by recrystallization.

Compound (21)

9-Fluorenone-4-carboxylic acid decyl ester (3.64 g, 0.01 mole) and a hydrazine having the formula $H_2N—NR_1R_2$, wherein $R_1$ is phenyl and wherein $R_2$ is the group X, wherein X is represented by the structure

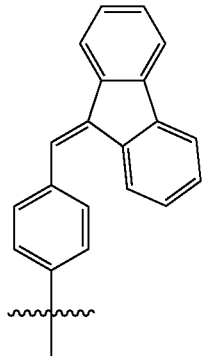

(3.6 g, 0.01 mole) in a molar ratio of 1:1 is refluxed in tetrahydrofuran (20 ml) for 16 hours with stirring. Upon removal of the solvent, the crude Compound (21) is isolated and purified by recrystallization.

G. Synthesis According to Formula VII

Compound (22)

A mixture of 4-Methylsulphonylphenylhydrazine hydrochloride (4.01 g, 18.0 mmol, commercially available from Fisher Scientific USA, Pittsburgh, Pa.), pentyl Fluorenone-4-carboxylic acid pentyl ester (5.30 g, 18.0 mmol) and AcONa (1.48 g, 18 mmol) in EtOH (100 mL) was refluxed for 5 h. The resulting mixture was cooled to 20-25° C.; precipitate was filtered, washed with EtOH and water to give pure XIX as yellow prisms; yield 89%; mp181-183° C.; 1H NMR and 13C NMR: H-NMR in CDCl3, chemical shifts in ppm: 0.94 (t, J=6.3 Hz, 3H), 1.38-1.43 (m, 4H), 1.84-1.77 (m, 2H), 3.07 (s, 3H), 4.37-4.45 (m, 2H), 7.20-7.42 (m, 5H), 7.66-7.71 (m, 1H), 7.81-7.84 (m, 3H), 7.87-8.39 (m, 2H), 9.11 (d, J=10.99 Hz, 1H).

Compound (23)

9-Fluorenone-4-carboxylic acid decyl ester (3.64 g, 0.01 mole) and 4-methylsulfonylphenylhydrazine (1.86 g, 0.01 mole, commercially available from Fisher Scientific USA, Pittsburgh, Pa.) in a molar ratio of 1:1 is refluxed in tetrahydrofuran (20 ml) for 16 hours with stirring. Upon removal of the solvent, the crude Compound (23) is isolated and purified by recrystallization.

H. Synthesis According to Formula VIII

N-(4-Stilbenyly-N-phenylhydrazine

N-(4-Stilbenyl)-N-phenylhydrazine can be prepared according to the procedure described in Zh. Org. Khim. (1967), 3(9), 1605-3 by Matevosyan et el., which is incorporated herein by reference. To a mixture of phenylhydrazine (97 g, 0.9 mole, commercially available from Aldrich, Milwaukee, Wis.) and p-chlorostilbene (21.4 g, 0.1 mole, commercially available from Spectrum Quality Products, Inc., Gardena, Calif.; Web: www.spectrumchemical.com) heated to boiling temperature, sodium was slowly added until there was no more discharge of red coloration. After boiling for some time the mixture was dissolved in 1750 ml of ethanol and cooled to −15° C. The precipitated product was recrystallized to give 28% of N-(4-stilbenyl)-N-phenylhydrazine.

Compound (24)

9-Fluorenone-4-carboxylic acid pentyl ester (2.94 g, 0.01 mole) and N-(4-stilbenyl)-N-phenylhydrazine (2.86 g, 0.01 mole) in a molar ratio of 1:1 is refluxed in tetrahydrofuran (20 ml) for 16 hours with stirring. Upon removal of the solvent, the crude Compound (24) is isolated and purified by recrystallization.

Compound (25)

9-Fluorenone-4-carboxylic acid decyl ester (3.64 g, 0.01 mole) and N-(4-stilbenyl)-N-phenylhydrazine (2.86 g, 0.01 mole) in a molar ratio of 1:1 is refluxed in tetrahydrofuran (20 ml) for 16 hours with stirring. Upon removal of the solvent, the crude Compound (25) is isolated and purified by recrystallization.

I. Synthesis According to Formula IX

5-Methyl-1-Phenyl-3-(1-Phenylhydrazino)-Pyrazole

5-Methyl-1-phenyl-3-(1-phenylhydrazino)-pyrazole can be prepared according to the procedure described in J. Chem. Soc. C (1971), (12), 2314-17 by Boyd et el., which is incorporated herein by reference.

Compound (26)

9-Fluorenone-4-carboxylic acid pentyl ester (2.94 g, 0.01 mole) and 5-methyl-1-phenyl-3-(1-phenylhydrazino)-pyrazole (2.64 g, 0.01 mole) in a molar ratio of 1:1 is refluxed in tetrahydrofuran (20 ml) for 16 hours with stirring. Upon removal of the solvent, the crude Compound (26) is isolated and purified by recrystallization.

Compound (27)

9-Fluorenone-4-carboxylic acid decyl ester (3.64 g, 0.01 mole) and 5-methyl-1-phenyl-3-(1-phenylhydrazino)-pyrazole (2.64 g, 0.01 mole) in a molar ratio of 1:1 is refluxed in tetrahydrofuran (20 ml) for 16 hours with stirring. Upon removal of the solvent, the crude Compound (27) is isolated and purified by recrystallization.

J. Synthesis According to Formula X

Preparation of 1-Aminopyrrole

1-Aminopyrrole was synthesized in two steps from the N-aminophthalamide (1) according to the following scheme.

Step one:—Preparation of 2-(1H-pyrrol-1-yl)-1H-isoindole-1,3(2H)-dione:—N-aminophthalamide (10 g, 62 mmol; obtained from Aldrich Chemicals; Milwaukee, Wis.) and 1,5-dimethoxytetrahydrofuran (12 mL, 90 mmol; obtained from Aldrich Chemicals; Milwaukee, Wis. ) were refluxed in 100 mL of dry 1,4-dioxane for few minutes to form a clear yellow solution. 5 N HCl (10 mL) was then added and stirred. White precipitate started to appear after 15-20 minutes. This solution with precipitate was allowed to stir for another 1 hour and was then cooled in an ice-water bath. The precipitate formed were filtered and washed with 150 mL of dioxane/water (1/3), and dried in air to give yellow prisms; yield 78%; mp 219-220° C.; $^{1}$H-NMR and $^{13}$C-NMR were in full agreement with the structure.

Step two:—Preparation of 1-aminopyrrole:—To a suspension of the yellow prisms (103 g, 0.5 mol) in 500 mL methanol, 30 mL of hydrazine hydrate (88%, w/v, obtained from Aldrich Chemicals, Milwaukee; Wis.) was added. The suspension disappeared and the resulting solution was heated to reflux. White solid was formed from the clear solution. After 45 minutes of heating under reflux, the reaction mixture was cooled to room temperature, and 15 mL of acetic acid was added and stirred. The solid obtained was filtered off and washed with methanol. The filtrate was collected and concentrated to give white residue to which NaOH (2M, 100 mL) was added to dissolve. This mixture was extracted with ether, dried over $MgSO_4$, and concentrated to give a product as yellow oil; yield 40%; $^{1}$H-NMR and $^{13}$C-NMR spectra were in full agreement with the structure of the compound. H-NMR in CDCl3, chemical shifts in ppm: 4.86 (br s, 2H), 6.04 (br s, 2H), 6.70 (br s, 2H). C-NMR in CDCl3, chemical shifts in ppm: 106.3, 121.9.

Compound (28)

9-Fluorenone-4-carboxylic acid pentyl ester (XII, 5.88 g, 10 mmol) and 1-aminopyrrole (1.64 g, 10 mmol) were refluxed in ethanol for 5 h in the presence of trace amount of acetic acid. The mixture was cooled to 0° C. and the solvent was filtered. The solid was washed with cold ethanol to give pure XV. Yellow crystals; yield 60%; mp 87.1-88° C.; 1H NMR and 13C NMR H-NMR in CDCl3, chemical shifts in ppm: 0.92-0.97 (t, J=3 Hz, 3H), 1.43-1.49 (m, 4H), 1.79-1.88 (m, 2H), 4.42 (t, 6.7 Hz, 2H), 6.32-6.33 (m, 2H), 6.79-6.88 (m, 2H), 6.95 (d, J=7.7 Hz, 1H), 7.01-7.17 (m, 1H), 7.36-7.51 (m, 2H), 7.89 (td, J=7.8 Hz, 42.6 Hz, 1H), 8.14 (t, J=7.5 Hz, 1H), 8.28 (d, J=7.8 Hz, 1H)

K. Ionization Potential Protocol

Samples for ionization potential (Ip) measurements were prepared by dissolving Compounds 4, 22, and 28, independently in tetrahydrofuran. Each solution was hand-coated on an aluminized polyester substrate that was precision coated with a methylcellulose-based adhesion sub-layer to form a charge transport material (CTM) layer. The role of this sub-layer was to improve adhesion of the CTM layer, to retard crystallization of CTM, and to eliminate the electron photoemission from the Al layer through possible CTM layer defects. No photoemission was detected from the Al through the sub-layer at illumination with up to 6.4 eV quanta energy light. In addition, the adhesion sub-layer was conductive enough to avoid charge accumulation on it during measurement. The thickness of both the sub-layer and CTM layer was ~0.4 μm. No binder material was used with CTM in the preparation of the samples for Ip measurements.

The ionization potential was measured by the electron photoemission in air method similar to that described in "Ionization Potential of Organic Pigment Film by Atmospheric Photoelectron Emission Analysis", *Electrophotography,* 28, Nr. 4, p. 364. (1989) by E. Miyamoto, Y. Yamaguchi, and M. Yokoyama, which is hereby incorporated by reference. The samples were illuminated with monochromatic light from the quartz monochromator with a deuterium lamp source. The power of the incident light beam was $2\text{-}5\cdot10^{-8}$ W. The negative voltage of −300 V was supplied to the sample substrate. The counter-electrode with the 4.5×15 $mm^2$ slit for illumination was placed at 8 mm distance from the sample surface. The counter-electrode was connected to the input of the BK2-16 type electrometer, working in the open impute regime, for the photocurrent measurement. A $10^{-15}$-$10^{-12}$ amp photocurrent was flowing in the circuit under illumination. The photocurrent, I, was strongly dependent on the incident light photon energy hv. The $I^{0.5}=f(hv)$ dependence was plotted. Usually the dependence of the square root of photocurrent on incident light quanta energy is well described by linear relationship near the threshold [see references "Ionization Potential of Organic Pigment Film by Atmospheric Photoelectron Emission Analysis", *Electrophotography,* 28, Nr. 4, p. 364. (1989) by E. Miyamoto, Y. Yamaguchi, and M. Yokoyama; and "Photoemission in Solids", Topics in Applied Physics, 26, 1-103. (1978) by M. Cordona and L. Ley]. The linear part of this dependence was extrapolated to the hv axis and Ip value was determined as the photon energy at the interception point. The ionization potential measurement has an error of ±0.03 eV. The ionization potential data are listed in Table 1.

L. Hole Mobility

Samples for charge carrier mobility measurements were prepared by dissolving Compounds 4, 22, and 28, independently in tetrahydrofuran with a binder to form 10% solid solutions. The binder was polycarbonate Z 200 (commercially obtained from Mitsubishi Engineering Plastics, White Plains, N.Y.). The sample/binder ratio was 4:6 or 5:5. Each solution was coated on an aluminized polyester substrate to form a charge transport material (CTM) layer. The thickness of the CTM layer varied in the range of 5-10 μm.

The hole drift mobility was measured by a time of flight technique as described in "The discharge kinetics of negatively charged Se electrophotographic layers," Lithuanian Journal of Physics, 6, p. 569-576 (1966) by E. Montrimas, V. Gaidelis, and A. Pažėra, which is hereby incorporated by reference. Positive corona charging created electric field inside the CTM layer. The charge carriers were generated at the layer surface by illumination with pulses of nitrogen laser (pulse duration was 2 ns, wavelength 337 nm). The layer surface potential decreased as a result of pulse illumination was up to 1-5% of initial potential before illumination. The capacitance probe that was connected to the wide frequency band electrometer measured the speed of the surface potential dU/dt. The transit time $t_r$ was determined by the change (kink) in the curve of the dU/dt transient in linear or double logarithmic scale. The drift mobility was calculated by the formula $\mu=d^2/U_0\cdot t_r$, where d is the layer thickness and $U_0$ is the surface potential at the moment of illumination. Mobility values at electric field strength, E, of $6.4\cdot10^5$ V/cm are given in the Table 1.

TABLE 1

| Compound | Charge carrier | Mobility ($cm^2$/Vs) | $I_P$ (eV) |
|---|---|---|---|
| 28 | Holes | No signal | 6.0 |
| | Electrons | No signal | |
| 4 | Holes | No signal | 5.95 |
| | Electrons | $\sim10^{-6}$ | |
| 22 | Holes | $\sim10^{-7}$ | 5.68 |
| | Electrons | — | |

M. Dual Layer Organophotoreceptor Preparation Methods

Inverted dual layer organophotoreceptor can be prepared by incorporating Compounds (2)-(28). A charge transport solution containing 50 wt. % of one the compounds in Polycarbonate Z binder can be prepared by combining a solution of 1.25 g of the compound in 8.0 g of tetrahydrofuran with 1.25 g of Polycarbonate Z in 2.50 g of toluene. The charge transport solution is then hand knife-coated onto a 3 mil (76 micrometer) thick aluminized polyethylene terephthalate film (Melinex 442 polyester film from Dupont having a 1 ohm/square aluminum vapor coat) having a 0.3 micron polyester resin sub-layer (Vitel PE-2200 from Bostik, Middletown, Mass.) and dried to form a charge transport layer having a thickness of 9 micrometers.

A dispersion can be prepared by micronising 700 g of suspension consisting of 112.7 g of oxytitanium phthalocyanine pigment (H. W. Sands Corp., Jupiter, Fla.), 49 g of S-Lec B Bx-5 polyvinylbutryal resin (Sekisui Chemical Co. Ltd.), and 651 g of methyl ethyl ketone using a horizontal sand mill operating in recirculation mode for 8 hours. A 10 g portion of the resulting dispersion is diluted by 3-fold with methyl ethyl ketone then hand knife-coated onto the charge transport layer from the preceding paragraph and dried at 80° C. for 10 minutes to form a charge generating layer having a thickness of 0.27 micrometer.

N. Single Layer Organophotoreceptor Preparation Methods

A single layer organophotoreceptor is fabricated by hand knife-coating a solution onto a 76.2 micron (3 mil) thick polyester substrate with a layer of vapor-coated aluminum (commercially obtained from CP Films, Martinsville, Va.). The coating solution for the single layer organophotoreceptor was prepared by combining 2.4 g of a premix solution containing 20 wt % electron transport compound in tetrahydrofuran, 6.66 g of a premix solution containing 25 wt % charge transfer material in tetrahydrofuran, 7.67 g of of a premix solution containing 12% polyvinyl butyral resin (BX-1, commercially obtained from Sekisui Chemical Co. Ltd., Japan) in tetrahydrofuran, 0.74 g of the CGM mill-base containing 19% of titanyl oxyphthalocyanine and a polyvinyl butyral resin (BX-5, commercially obtained from Sekisui Chemical Co. Ltd., Japan) at a ratio of 2.3:1, and an additional 0.34 g of tetrahydrofuran to produce a final solution containing 18 wt % solids. The CGM mill-base was obtained by milling 112.7 g of titanyl oxyphthalocyanine (commercially obtained from H. W. Sands Corp., Jupiter, Fla.) with 49 g of the polyvinyl butyral resin (BX-5) in 651 g of MEK on a horizontal sand mill (model LMC12 DCMS, commercially obtained from Netzsch Incorporated, Exton, Pa.) with 1-micron zirconium beads using recycle mode for 4-8 hours. After mixing the final solution on a mechanical shaker for ~1 hour, the single layer coating solution was coated onto the substrate described above using a knife coater with a gap space of 94 micron followed by drying in an oven at 110° C. for 5 minutes.

O. Electrostatic Testing

Extended electrostatic cycling performance of the charge transfer compounds of this invention is determined using an in-house designed and developed test bed that tests up to 3 samples strips that are wrapped around a drum. The three coated sample strips, each measuring 50 cm long by 8.8 cm wide, were fastened side-by-side and completely around an aluminum drum (50.3 cm circumference). At least one of the strips was a control sample (e.g., U.S. Pat. No. 6,140,04 compound 2) that was precision web coated and used as an internal reference point. In this electrostatic cycling tester, the drum rotated at a rate of 8.13 cm/s (3.2 ips) and the location of each station in the tester (distance and elapsed time per cycle) is given as:

Electrostatic test stations around the sample sheet wrapped drum.

| Station | Degrees | Total Distance, cm | Total Time, sec |
|---|---|---|---|
| Front erase bar edge | 0° | Initial, 0 cm | Initial, 0 s |
| Erase Bar | 0-7.2° | 0-1.0 | 0-0.12 |
| Scorotron | 113.1-135.3° | 15.8-18.9 | 1.94-2.33 |
| Laser Strike | 161.0° | 22.5 | 2.77 |
| Probe #1 | 181.1° | 25.3 | 3.11 |
| Probe #2 | 251.2° | 35.1 | 4.32 |
| Erase bar | 360° | 50.3 | 6.19 |

From the table, the first electrostatic probe (TREK™ 344 electrostatic meter) is located 0.34 s after the laser strike station and 0.78 s after the scorotron. Also, the second probe (TREK™ 344 electrostatic meter) is located 1.21 s from the first probe and 1.99 s from the scorotron. All measurements were performed at ambient temperature and relative humidity.

Electrostatic measurements were obtained as a compilation of several tests. The first three diagnostic tests (prodstart, VlogE initial, dark decay initial) are designed to evaluate the electrostatic cycling of a new, fresh sample and the last three, identical diagnostic tests (prodend, VlogE final, dark decay final) are run after cycling of the sample (longrun).

1. PRODTEST: A charge acceptance and discharge voltage baseline was established by subjecting the samples to corona charging (erase bar always on) for three complete drum revolutions (laser off); discharged with the laser @ 780 nm & 600 dpi on the forth cycle; completely charged for the next three cycles (laser off); discharged with only the erase lamp @ 720 nm on the eighth cycle (corona and laser off); and, finally, completely charged for the last three cycles (laser off).
2. VLOGE: This test measures the photoinduced discharge of the photoconductor to various laser intensity levels by monitoring the discharge voltage of the belt as a function of the laser power (exposure duration of 50 ns) with fixed exposure times and constant initial potentials.
3. DARK DECAY: This test measures the loss of charge acceptance with time without laser or erase illumination for 90 seconds and can be used as an indicator of i) the injection of residual holes from the charge generation layer to the charge transport layer, ii) the thermal liberation of trapped charges, and iii) the injection of charge from the surface or aluminum ground plane.
4. LONGRUN: The belt was electrostatically cycled for 100 drum revolutions according to the following sequence per each belt-drum revolution. The belt was charged by the corona, the laser was cycled on and off (80-100° sections) to discharge a portion of the belt and, finally, the erase lamp discharged the whole belt in preparation for the next cycle. The laser was cycled so that the first section of the belt was never exposed, the second section was always exposed, the third section was never exposed, and the final section was always exposed. This pattern was repeated for a total of 100 drum revolutions and the data for every $5^{th}$ cycle was recorded.
5. After the 100th cycle (long run test), the PRODTEST, VLOGE, DARK DECAY diagnostic tests were run again.

Preparation of (4-n-Butoxycarbonyl-9-fluorenylidene) Malononitrile

To a 1-liter 3-neck round bottom flask, equipped with thermometer, mechanical stirrer and reflux condenser were added 460 g of concentrated sulfuric acid (4.7 moles, analytical grade, commercially obtained from Sigma-Aldrich, Milwaukee, Wis.) and 100 g of diphenic acid (0.41 mole, commercially obtained from Acros Fisher Scientific Company Inc., Hanover Park, Ill.). Using heating mantle, the flask was heated to 135-145° C. for 12 minutes, and then cooled to RT. After cooled to RT, the solution was added to a 4 liter Erlenmeyer containing 3 liter of water. The mixture was stirred mechanically and was boiled gently for one hour. A yellow solid was filtered out hot, washed with hot water until the pH of the washing water was neutral, and dried in the air overnight. The yellow solid was fluorenone-4-carboxylic acid (75 g, 80% yield, m.p. 223-224° C.). A $^1$H-NMR spectrum of fluorenone-4-carboxylic acid was obtained in $d_6$-DMSO by a 300 MHz NMR from Bruker Instrument. The peaks were found at δ=7.39-7.50 (m, 2H); δ=7.79-7.70 (q, 2H); δ=7.74-7.85 (d, 1H); δ=7.88-8.00 (d, 1H ); and δ=8.18-8.30 (d, 1H), where d is doublet, t is triplet, m is multiplet; dd is double doublet, q is quintet.

To a 2-liter round bottom flask equipped with a mechanical stirrer and a reflux condenser with a Dean Stark apparatus were added 70 g (0.312 mole) of fluorenone-4-carboxylic acid, 480 g (6.5 mole) of n-Butanol (commercially obtained from Fisher Scientific Company Inc., Hanover Park, Ill.), 1000 ml of Toluene and 4 ml of concentrated sulfuric acid. The solution was refluxed for 5 hours with aggressive agitation and refluxing, during which ~6 g of water were collected in the Dean Stark apparatus. The flask was cooled to room temperature. The solvents were evaporated and the residue was added to 4-liter of 3% sodium bicarbonate aqueous solution with agitation. The solid was filtered off, washed with water until the pH of the water was neutral, and dried in the hood overnight. The product was n-butyl fluorenone-4-carboxylate ester (70 g, 80% yield). A $^1$H-NMR spectrum of n-butyl fluorenone-4-carboxylate ester was obtained in $CDCl_3$ by a 300 MHz NMR from Bruker Instrument. The peaks were found at δ=0.87-1.09 (t, 3H); δ=1.42-1.70 (m, 2H); δ=1.75-1.88 (q, 2H); δ=4.26-4.64 (t, 2H); δ=7.29-7.45 (m, 2H); δ=7.46 -7.58 (m, 1H); δ=7.60-7.68 (dd, 1H); δ=7.75-7.82 (dd, 1H); δ=7.90-8.00 (dd, 1H); δ=8.25-8.35 (dd, 1H).

To a 2-liter, 3-neck round bottom flask equipped with a mechanical stirrer and a reflux condenser were added 70 g (0.25 mole) of n-butyl fluorenone-4-carboxylate ester, 750 ml of absolute methanol, 37 g (0.55 mole) of malononitrile (commercially obtained from Sigma-Aldrich, Milwaukee, Wis.), 20 drops of piperidine (commercially obtained from Sigma-Aldrich, Milwaukee, Wis.). The solution was refluxed for 8 hours and the flask was cooled to room temperature. The orange crude product was filtered, washed twice with 70 ml of methanol and once with 150 ml of water, and dried in the hood for overnight. This orange crude product was recrystalized from a mixture of 600 ml of acetone and 300 ml of methanol using activated charcoal. The flask was placed at 0° C. for 16 hours. The crystals were filtered and dried in a vacuum oven at 50° C. for 6 hours to obtain 60 g of pure (4-n-butoxycarbonyl-9-fluorenylidene) malononitrile. The m.p. was 99-100° C. A $^1$H-NMR spectrum of (4-n-butoxycarbonyl-9-fluorenylidene) malononitrile was obtained in $CDCl_3$ by a 300 MHz NMR from Bruker Instrument. The peaks were found at δ=0.74-1.16 (t, 3H); δ=1.38-1.72 (m, 2H); δ=1.70-1.90 (q, 2H); δ=4.29-4.55 (t, 2H); δ=7.31-7.43 (m, 2H); δ=7.45-7.58 (m, 1H); δ=7.81-7.91 (dd, 1H); δ=8.15-8.25 (dd, 1H); δ=8.42-8.52 (dd, 1H ); δ=8.56-8.66 (dd, 1H).

Comparative Example A

Comparative Example A was a single layer organophotoreceptor having a 76.2 micron (3 mil) thick polyester substrate having a layer of vapor-coated aluminum (commercially obtained from CP Films, Martinsville, Va.). The coating solution for the single layer organophotoreceptor was prepared by pre-mixing 2.4 g of 20% (4-n-butoxycarbonyl-9-fluorenylidene) malononitrile in tetrahydrofuran, 6.66 g of 25% MPCT-10 (a charge transfer material, commercially obtained from Mitsubishi Paper Mills, Tokyo, Japan) in tetrahydrofuran, 7.65 g of 12% polyvinyl butyral resin (BX-1, commercially obtained from Sekisui Chemical Co. Ltd., Japan) in tetrahydrofuran. To the above mixture was then added 0.74 g of a CGM mill-base containing 19% of titanyl oxyphthalocyanine and a polyvinyl butyral resin (BX-5, commercially obtained from Sekisui Chemical Co. Ltd., Japan) at a ratio of 2.3:1. The CGM mill-base was obtained by milling 112.7 g of titanyl oxyphthalocyanine (commercially obtained from H. W. Sands Corp., Jupiter, Fla.) with 49 g of the polyvinyl butyral resin (BX-5) in 651 g of MEK on a horizontal sand mill (model LMC12 DCMS, commercially obtained from Netzsch Incorporated, Exton, Pa.) with 1-micron zirconium beads using recycle mode for 4 hours. After mixing on a mechanical shaker for ~1 hour, the single layer coating solution was coated onto the substrate described above using a knife coater with a gap space of 94 micron followed by drying in an oven at 110° C. for 5 minutes.

The following table shows the electrostatic cycling performance for Compound (4) prepared using the procedure described above using Compound (4) as the electron transport compound and Comparative Example A using (4-n-butoxycarbonyl-9-fluorenylidene) malononitrile, all other components remained the same.

| | Prodstart | | | | | | Prodstop | | | | |
|---|---|---|---|---|---|---|---|---|---|---|---|
| Sample | CA | Disch | Cont. | S780 | DD | Res | CA | Disch | Cont. | DD | Res |
| Compound (4) | 605 | 30 | 575 | 370 | 37 | 10 | 592 | 30 | 562 | 39 | 10 |
| Comparative* | 557 | 75 | 482 | 250 | 31 | 37 | 398 | 65 | 333 | 27 | 38 |

*= (4-n-butoxycarbonyl-9-fluorenylidene) malononitrile

In the above table the contrast voltage (Cont.) is the difference in voltage, as measured by probe #1, between the charge acceptance voltage (CA) and the laser discharge voltage (Disch). The functional dark decay (DD) over 1.2 seconds is determined as the difference in voltage between probes #1 and #2, The residual voltage (Res) was determined on the eighth cycle of the prodtest—9.2 seconds after the previous corona charge and 3 seconds after the erase. The radiation sensitivity (Sensitivity at 780 nm in m2/J) of the xerographic process was determined from the information obtained during the VLOGE diagnostic run by calculating the reciprocal of the product of the laser power required to discharge the photoreceptor to ½ of its initial potential, the exposure duration, and 1/spot size.

As is well understood by those skilled in the art, additional substitution, variation among substituents, and alternative methods of synthesis and use may be practiced within the scope and intent of the present disclosure of the invention. Those other embodiments are within the following claims.

What is claimed is:

1. An organophotoreceptor comprising:

(a) a charge transport material having a central nucleus of the formula

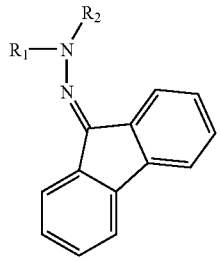

wherein $R_1$ is selected from the group consisting of a sulfolanyl group, a pyrrolyl group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

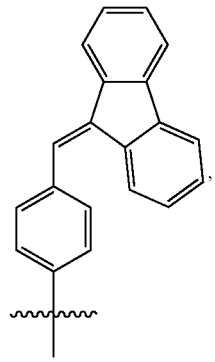

and $R_2$ is selected from the group consisting of hydrogen, an alkyl group, and an aryl group, with the proviso that when $R_1$ is an alkylsulfonylphenyl group, $R_2$ is not hydrogen;

(b) a charge generating compound; and (c) an electrically conductive substrate.

2. The organophotoreceptor of claim 1 wherein the charge transport material has a central nucleus of the formula:

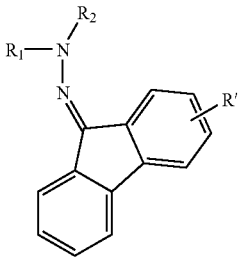

wherein $R_1$ is selected from the group consisting of a sulfolanyl group, a pyrrolyl group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonyiphenyl group, and group X, where X is represented by the formula

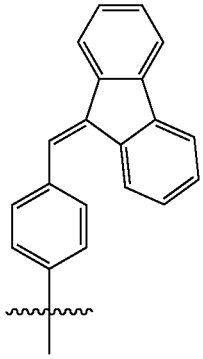

$R_2$ is selected from the group consisting of hydrogen, an alkyl group, and an aryl group; and R' is selected from the group consisting of hydrogen, a halogen, hydroxyl, thiol, nitro, nitrile, a branched or linear alkoxy group, a branched or linear alkyl group, a branched, cyclic or linear unsaturated hydrocarbon group, an ester group, an ether group, an amino group, a heterocyclic group, and an aryl group, with the proviso that when $R_1$ is an alkylsulfonylphenyl group, R' is not hydrogen.

3. The organophotoreceptor of claim 2 wherein a single layer comprises the charge generating material, the charge transport material, and an electron-transport compound.

4. The organophotoreceptor of claim 2 wherein R' is an ester group.

5. The organophotoreceptor of claim 4 wherein R' is a $CO_2R''$ group where R" is selected from the group consisting of $—C_4H_9$, $—C_5H_{11}$ and $—C_{10}H_{21}$.

6. The organophotoreceptor of claim 1 wherein the charge transport material comprises at least one compound having the general formula

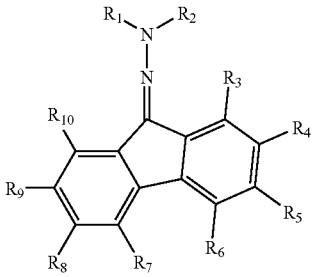

where $R_1$ is selected from the group consisting of a sulfolanyl group, a pyrrolyi group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonyiphenyl group, and group X, wherein X is represented by the formula

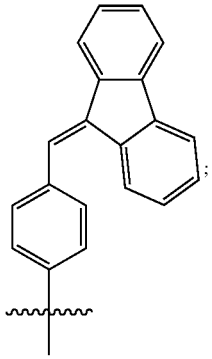

$R_2$ is hydrogen, a branched or linear alkyl group, a cycloalkyl group, or an aryl group, with the proviso that when $R_1$ is an alkylsulfonylphenyl group, $R_2$ is not hydrogen; and $R_3$, $R_4$, $R_5$, $R_6$, $R_7$, $R_8$, $R_9$, and $R_{10}$ are, independently, hydrogen, halogen, hydroxyl, thiol, nitro, nitrile, a branched or linear alkoxy group, a branched or linear alkyl group, a branched or linear unsaturated hydrocarbon group, an ester group, an ether group, an amino group, a cycloalkyl group, a heterocyclic group, or an aryl group.

7. An organophotoreceptor according to claim 6 wherein $R_1$ is a sulfolanyl group.

8. An organophotoreceptor according to claim 6 wherein $R_1$ is a pyrrolyl group.

9. An organophotoreceptor according to claim 6 wherein $R_1$ is a tetrazolyl group.

10. An organophotoreceptor according to claim 6 wherein $R_1$ is a benzotriazolyl group.

11. An organophotoreceptor according to claim 6 wherein $R_1$ is a pyrazolyl group.

12. An organophotoreceptor according to claim 6 wherein $R_1$ is group X, wherein X is represented by the formula

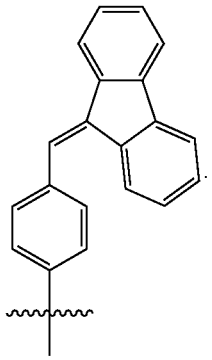

13. An organophotoreceptor according to claim 6 wherein $R_1$ is an alkylsulfonylphenyl group.

14. The organophotoreceptor of claim 6 wherein a single layer comprises the charge generating material, the charge transport material, and an electron-transport compound.

15. An organophotoreceptor according to claim 1 wherein said organophotoreceptor is in the form of a flexible belt.

16. An organophotoreceptor according to claim 1 wherein said organophotoreceptor is in the form of a drum.

17. An organophotoreceptor according to claim 1 comprising:

(a) a charge transport layer comprising said charge transport material and a polymeric binder;

(b) a charge generating layer comprising said charge generating compound and a polymeric binder; and (c) said electrically conductive substrate.

18. The organophotoreceptor of claim 1 wherein a single layer comprises the charge generating material, the charge transport material, and an electron-transport compound.

19. The organophotoreceptor of claim 1 wherein $R_2$ is an alkyl group or an aryl group.

20. An electrophotographic imaging apparatus comprising:

(a) a plurality of support rollers; and (b) an organophotoreceptor in the form of a flexible belt threaded around said support rollers, said organophotoreceptor comprising:

(i) a charge transport material having a central nucleus of the formula

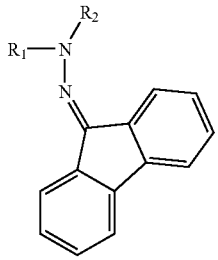

wherein $R_1$ is selected from the group consisting of a sulfolanyl group, a pyrrolyl group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

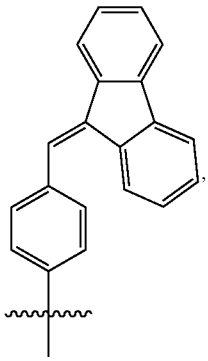

and $R_2$ is selected from the group consisting of hydrogen, an alkyl group, and an aryl group, with the proviso that when $R_1$ is an alkylsulfonyiphenyl group, $R_2$ is not hydrogen;

(ii) a charge generating compound; and (iii) an electrically conductive substrate.

21. The electrophotographic imaging apparatus of claim 20 wherein the charge transport material has a central nucleus of the formula:

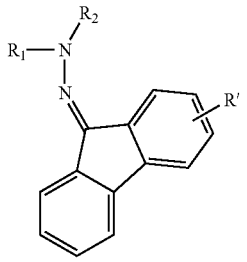

wherein $R_1$ is selected from the group consisting of a sulfolanyl group, a pyrrolyl group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonyiphenyl group, and group X, wherein X is represented by the formula

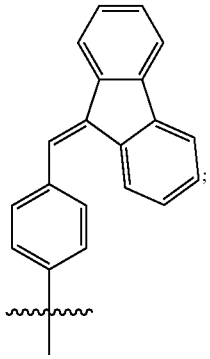

$R_2$ is selected from the group consisting of hydrogen, an alkyl group, and an aryl group; and R' is selected from the group consisting of hydrogen, a halogen, hydroxyl, thiol, nitro, nitrile, a branched or linear alkoxy group, a branched or linear alkyl group, a branched, cyclic or linear unsaturated hydrocarbon group, an ester group, an ether group, an amino group, a heterocyclic group, and an aryl group, with the proviso that when $R_1$ is an alkylsulfonylphenyl group, $R_2$ is not hydrogen.

22. The electrophotographic imaging apparatus of claim 21 wherein R' is a $CO_2R''$ group where R" is selected from the group consisting of $—C_4H_9$, $—C_5H_{11}$ and $—C_{10}H_{21}$.

23. The electrophotographic imaging apparatus of claim 20 wherein the charge transport material has the general formula of:

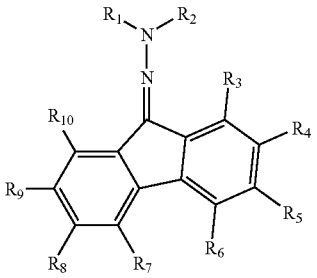

where $R_1$ is selected from the group consisting of a sulfolanyl group, a pyrrolyl group, a pyrazolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

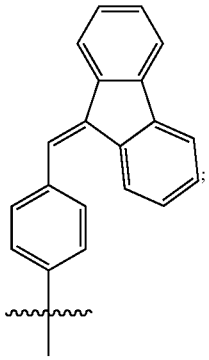

$R_2$ is hydrogen, a branched or linear alkyl group, a cycloalkyl group, or an aryl group, with the proviso that when $R_1$ is an alkylsulfonyiphenyl group, $R_2$ is not hydrogen; and $R_3$, $R_4$, $R_5$, $R_6$, $R_7$, $R_8$, $R_9$, and $R_{10}$ are, independently, hydrogen, halogen, hydroxyl, thiol, nitro, nitrile, a branched or linear alkoxy group, a branched or linear alkyl group, a branched or linear unsaturated hydrocarbon group, an ester group, an ether group, an amino group, a cycloalkyl group, a heterocyclic group, or an aryl group.

24. An electrophotographic imaging apparatus according to claim 23 wherein $R_1$ is a sulfolanyl group.

25. An electrophotographic imaging apparatus according to claim 23 wherein $R_1$ is a pyrrolyl group.

26. An electrophotographic imaging apparatus according to claim 23 wherein $R_1$ is a tetrazolyl group.

27. An electrophotographic imaging apparatus according to claim 23 wherein $R_1$ is a benzotriazolyl group.

28. An electrophotographic imaging apparatus according to claim 23 wherein $R_1$ is a pyrazolyl group.

29. An electrophotographic imaging apparatus according to claim 23 wherein $R_1$ is group X, wherein X is represented by the formula

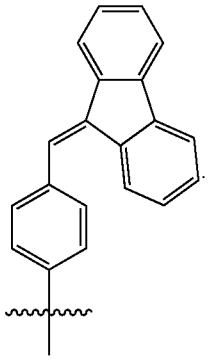

30. An electrophotographic imaging apparatus according to claim 23 wherein $R_1$ is an alkylsulfonyiphenyl group.

31. The electrophotographic imaging apparatus of claim 20 wherein the organophotoreceptor comprises a single layer comprising the charge generating material, the charge transport material, and an electron-transport compound.

32. The electrophtographic imaging apparatus of claim 20 wherein $R_2$ is an alkyl group or an aryl group.

33. A charge transport material having a central nucleus of the formula

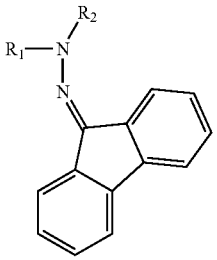

wherein $R_1$ is selected from the group consisting of a sulfolanyl group, a pyrrolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

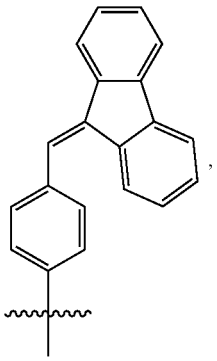

and $R_2$ is selected from the group consisting of hydrogen, an alkyl group, and an aryl group, with the proviso that when $R_1$ is an alkylsulfonyiphenyl group, $R_2$ is not hydrogen.

34. The charge transport material of claim 33 wherein the charge transport material has a central nucleus of the formula:

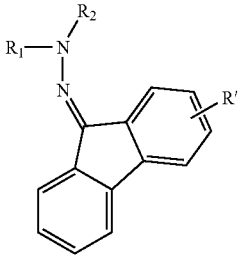

wherein $R_1$ is selected from the group consisting of a sulfolanyl group, a pyrrolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

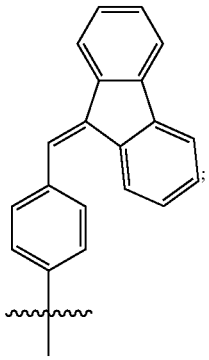

$R_2$ is selected from the group consisting of hydrogen, an alkyl group, and an aryl group; and R' is selected from the group consisting of hydrogen, a halogen, hydroxyl, thiol, nitro, nitrile, a branched or linear alkoxy group, a branched or linear alkyl group, a branched, cyclic or linear unsaturated hydrocarbon group, an ester group, an ether group, an amino group, a heterocyclic group, and an aryl group, with the proviso that when $R_1$ is an alkylsulfonyiphenyl group, $R_2$ is not hydrogen.

35. The charge transport material of claim 34 wherein R' is an ester group.

36. The charge transport material of claim 35 wherein R' is a $CO_2R''$ group where R" is selected from the group consisting of $—C_4H_9$, $—C_5H_{11}$ and $—C_{10}H_{21}$.

37. The charge transport material of claim 33 wherein the charge transport material has a formula:

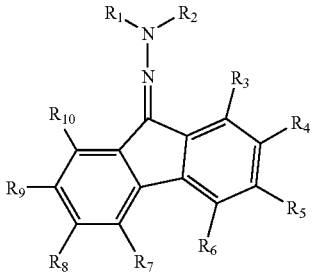

where $R_1$ is selected from the group consisting of a sulfolanyl group, a pyrrolyl group, a tetrazolyl group, an indolyl group, a carbazolyl group, a triazolyl group, an imidazolyl group, a benzimidazolyl group, an indazolyl group, a benzotriazolyl group, an alkylsulfonylphenyl group, and group X, wherein X is represented by the formula

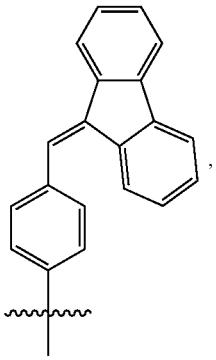

$R_2$ is hydrogen, a branched or linear alkyl group, a cycloalkyl group, or an aryl group, with the proviso that when R1 is an alkylsulfonyiphenyl group, $R_2$ is not hydrogen; and $R_3$, $R_4$, $R_5$, $R_6$, $R_7$, $R_8$, $R_9$, and $R_{10}$ are, independently, hydrogen, halogen, hydroxyl, thiol, nitro, nitrile, a branched or linear alkoxy group, a branched or linear alkyl group, a branched or linear unsaturated hydrocarbon group, an ester group, an ether group, an amino group, a cycloalkyl group, a heterocyclic group, or an aryl group.

38. A charge transport material according to claim 37 wherein $R_1$ is a sulfolanyl group.

39. A charge transport material according to claim 37 wherein $R_1$ is a pyrrolyl group.

40. A charge transport material according to claim 37 wherein $R_1$ is a tetrazolyl group.

41. A charge transport material according to claim 37 wherein $R_1$ is a benzotriazolyl group.

42. A charge transport material according to claim 37 wherein $R_1$ is group X, wherein X is represented by the formula

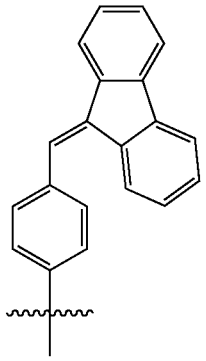

43. A charge transport material according to claim 37 wherein $R_1$ is an alkylsulfonylphenyl group.

44. The charge transport material of claim 33 wherein $R_2$ is an alkyl group or an aryl group.

* * * * *